US005784675A

United States Patent [19]

Inoue et al.

[11] Patent Number: 5,784,675

[45] Date of Patent: Jul. 21, 1998

[54] IMAGE FORMING APPARATUS WITH RECORDING MATERIAL CARRYING MEMBER HAVING RECESSES

[75] Inventors: Masahiro Inoue; Yoshihiro Murasawa, both of Yokohama; Tatsuo Takeuchi, Kawasaki; Rie Saito, Yokohama; Yasuo Nami; Rie Nakashimizu, both of Kawasaki, all of Japan

[73] Assignee: Canon Kabushiki Kaisha, Tokyo, Japan

[21] Appl. No.: 954,876

[22] Filed: Oct. 21, 1997

Related U.S. Application Data

[63] Continuation of Ser. No. 683,916, Jul. 19, 1996, abandoned, which is a continuation of Ser. No. 136,105, Oct. 14, 1993, abandoned.

[30] Foreign Application Priority Data

| | | | |
|---|---|---|---|
| Oct. 16, 1992 | [JP] | Japan | 4-305005 |
| Oct. 16, 1992 | [JP] | Japan | 4-305006 |
| Oct. 16, 1992 | [JP] | Japan | 4-305007 |

[51] Int. Cl.[6] ..... G03G 15/16

[52] U.S. Cl. ..... 399/297; 399/309; 399/324

[58] Field of Search ..... 399/297, 101, 399/303–305, 324, 325, 306, 309; 430/99; 428/156

[56] References Cited

U.S. PATENT DOCUMENTS

| | | | |
|---|---|---|---|
| 4,352,847 | 10/1982 | Okiyama | 428/141 |
| 4,724,458 | 2/1988 | Roy et al. | 355/274 |
| 4,935,776 | 6/1990 | Fukui | 399/303 |
| 4,960,050 | 10/1990 | Hatch | 101/348 |
| 5,027,159 | 6/1991 | Oda et al. | 399/309 |
| 5,083,167 | 1/1992 | Fukushima et al. | 355/274 |
| 5,084,737 | 1/1992 | Hagen et al. | 355/274 |
| 5,085,962 | 2/1992 | Aslam et al. | 430/99 |
| 5,091,751 | 2/1992 | Inoue et al. | 355/274 |
| 5,093,180 | 3/1992 | Morgan | 428/156 |
| 5,132,712 | 7/1992 | Fletcher et al. | 399/178 |
| 5,155,535 | 10/1992 | Bermel et al. | 355/274 |
| 5,187,536 | 2/1993 | Hasegawa et al. | 355/327 |
| 5,243,393 | 9/1993 | Menjo | 355/284 |
| 5,523,830 | 6/1996 | Tamura et al. | 399/297 |

FOREIGN PATENT DOCUMENTS

| | | |
|---|---|---|
| 06897 | 5/1991 | European Pat. Off. . |
| 487046 | 5/1992 | European Pat. Off. . |
| 3940217 | 7/1990 | Germany . |
| 59-053872 | 3/1984 | Japan . |
| 4-114185 | 4/1992 | Japan . |
| 4-249278 | 4/1992 | Japan . |
| 4-195173 | 7/1992 | Japan . |
| WO-02792 | 5/1987 | WIPO . |

OTHER PUBLICATIONS

"Paper Pre–Coating System", Xerox Disclosure Journal, vol. 1, No. 3, p. 35, C.A. Whited (Mar. 1976).

European Search Report.

*Primary Examiner*—William J. Royer

*Attorney, Agent, or Firm*—Fitzpatrick, Cella, Harper & Scinto

[57] ABSTRACT

An image forming apparatus includes image an bearing member or members; a movable recording material carrying member for carrying a recording material, with an image being transferred at a transfer position from the image bearing member or members onto a recording material carried on the recording material carrying member; and there are a plurality of recesses extending in a direction of movement of the recording material carrying member, provided on the surface of the recording material carrying member that carries the recording material.

56 Claims, 17 Drawing Sheets

IMAGE FORMING APPARATUS WITH RECORDING MATERIAL CARRYING MEMBER HAVING RECESSES

This application is a continuation of application Ser. No. 08/683,916, filed Jul. 19, 1996, now abandoned, which is a continuation of application Ser. No. 08/136,105, filed Oct. 14, 1993, now abandoned.

FIELD OF THE INVENTION AND RELATED ART

The present invention relates to an image forming apparatus such as a copying machine, a laser beam printer or the like, more particularly to an image forming apparatus suitable for forming full-color images on both sides of a recording material.

In an image forming apparatus such as a copying machine, a laser beam printer or the like, a toner image formed on a photosensitive drum through a charging, image exposing and developing processes, is transferred onto a recording material such as paper by a transfer device, and thereafter, the image is heated and pressed by a fixing roller and a pressing roller of a fixing device into a permanent image.

In a four-full-color image forming apparatus or another multi-color image forming apparatus, different color toner (four different color toners) are used. The four color toners are superposedly and sequentially transferred onto the recording material carried or wrapped on the transfer drum, and thereafter, the images are fixed. Therefore, the color toner is required to have good fusibility and color mixing nature when heated by the heating device. If not, many air gaps will be produced between adjacent toner particles with the result of diffraction of light at the interface between the air and the toner particles with the result of loosing the original color of the toner. Where the toner particles are overlaid, the lower layer toner is covered by the upper layer toner with the result of poor color reproduction. In order to satisfy such fusing property and color fixing property, so-called sharp melting toner is used which has low softening point and the fused viscosity is low. By using such toner, the color reproduction can be enhanced so that the faithful copy can be provided.

However, the sharp melting toner also exhibits high affinity, and therefore, the toner is easily offset to the fixing roller. The recording material having the four color toner images is subjected to the pressure as well as the heat in the fixing device. Therefore, the toner showing the high affinity tends to transfer and to be deposited on the fixing roller by the heat and the pressure. If the toner is transferred to the fixing roller, the toner is then transferred onto the recording material, or it is solidified on the fixing roller. They cause deterioration of image quality.

In order to avoid this, a parting agent is used. Prior to the fixing of the toner image on the recording material in the fixing device, a liquid parting agent such as oil is applied onto the fixing roller. By doing so, upon the heating and pressurizing the toner image, the fixing roller is prevented from direct contact with the toner image on the recording material, but is permitted to contact it through the parting agent therebetween, thus effectively preventing the transfer and deposition of the toner to the fixing roller.

The parting agent remaining on the fixing roller after the toner image fixing, is removed by a cleaning device provided with unwoven textile or the like.

However, according to this conventional prior art, the transfer of the toner to the fixing roller can be prevented by the use of the parting agent. However, when the images are formed on both sides of the recording material, the parting agent transfers from the recording material to the transfer drum, and further from the transfer drum to the photosensitive drum, with the result of improper image formation.

It is assumed that a first image is formed on a first side of a recording material, and thereafter, a second image is formed on a second side thereof. The first side of the recording material receives the parting agent by the first side copy operation. This transfer of the parting agent is not a problem if the image is not formed on the second side. However, when the image is formed on the second side, and when the recording material is wrapped on the transfer drum for the purpose of receiving the toner image, the first side of the recording material, that is, the side now having the transferred parting agent during the first copy operation, is contacted to the surface of the transfer drum. By this, the parting agent transfers to the surface of the transfer drum. Thereafter, when the recording material is separated toward the fixing device, the parting agent on the transfer drum now transferred and deposited onto the surface of the photosensitive drum contacted to the transfer drum. If the parting agent is transferred and deposited on the photosensitive drum in this manner, the parting agent can not be sufficiently removed by a cleaning device for the photosensitive drum which is intended to remove the residual toner from the photosensitive drum. Therefore, the residual toner or the like is mixed with the parting agent such as oil on the photosensitive drum. This makes the removal of the residual toner from the photosensitive drum more difficult, thus resulting in insufficient removal of the residual toner by the cleaning device. In addition, if the parting agent is deposited on the photosensitive drum, the toner from the developing device, in addition to the residual toner, are easily deposited on the area outside the image forming area. Particularly in the case of jumping development in which the toner moves through a space between the photosensitive drum and the developer carrying sleeve, the toner deposition increases. In this manner, the residual toner and the toner in the developing device, are deposited on the photosensitive drum because of the existence of the parting agent on the photosensitive drum, and the toner particles are transferred in the subsequent copy operation with the result of contamination of the image.

SUMMARY OF THE INVENTION

Accordingly, it is a principal object of the present invention to provide an image forming apparatus in which the transfer and deposition of a parting agent from the recording material carrying member to the image bearing member.

It is another object of the present invention to provide an image forming apparatus in which the improper image formation due to the position of the parting agent on the image bearing member, can be prevented.

It is a further object of the present invention to provide an image forming apparatus capable of forming satisfactory images on both sides of the recording material.

It is yet further object of the present invention to provide an image forming apparatus in which improper cleaning operation for the image bearing member is prevented.

It is a yet further object of the present invention to provide such an image forming method.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
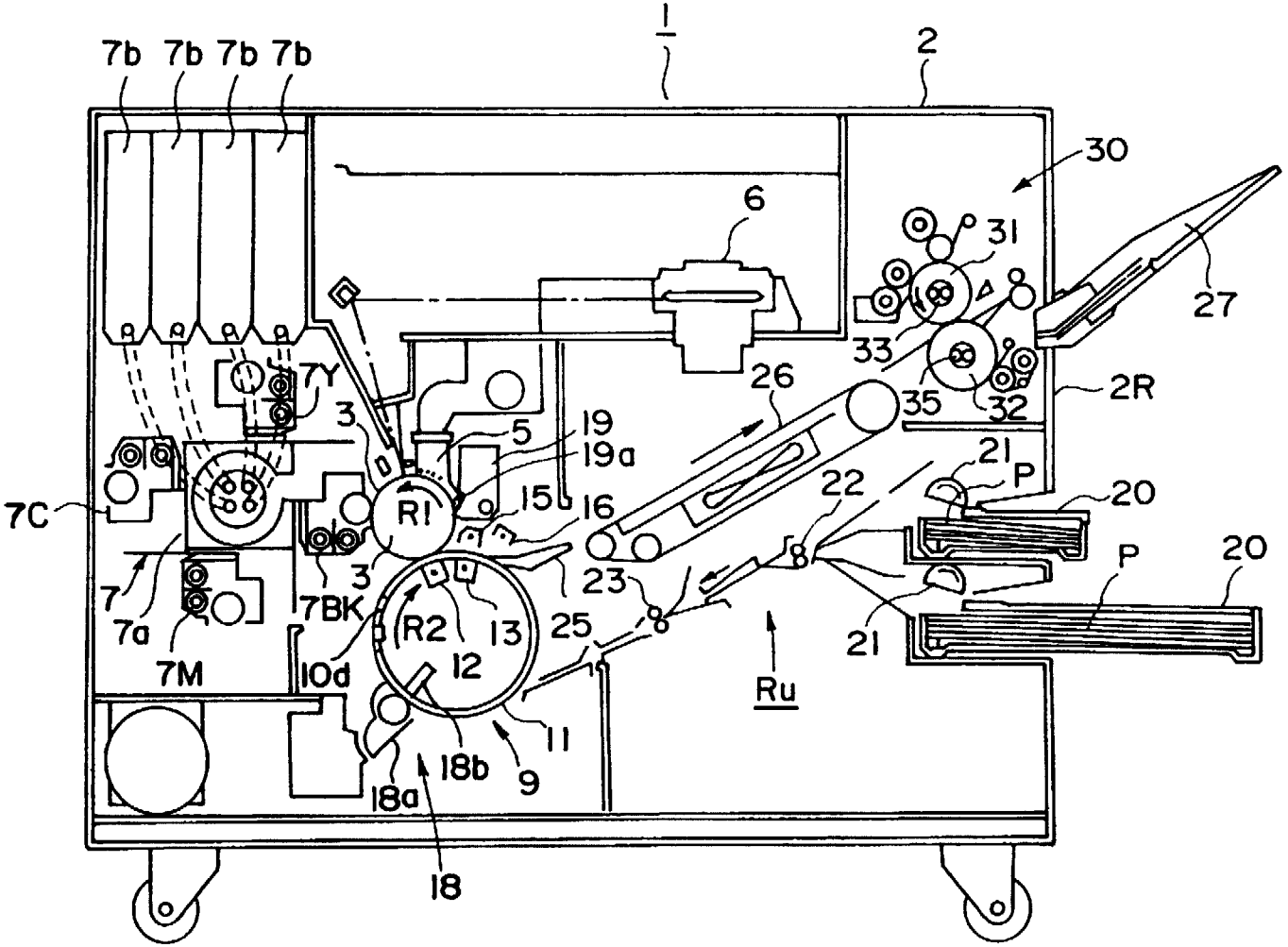
FIG. 1 is a sectional view of an image forming apparatus according to an embodiment of the present invention.

Referring to FIG. 1, there is shown an exemplary image forming apparatus in the form of four color full-color laser beam printer 1.

The laser beam printer 1 comprises a photosensitive drum functioning as an image bearing member substantially at the center of the main assembly 2. The photosensitive drum 3 has a photosensitive layer thereon, and is rotatably supported on the main assembly 2. It is driven in a direction R1 by an unshown driving device.

Around the photosensitive drum 3, there are disposed, a primary charger (charging device) 5 for uniformly charging the surface of the photosensitive drum 3, a laser beam exposure device (exposure means) 6 for forming an electrostatic latent image by application light on the surface of the photosensitive drum 3, a developing device 7 for forming a toner image by depositing the toner on the electrostatic latent image, in the order named along the rotational direction.

The developing device 7 of FIG. 1 is of a rotary type, and comprises a rotatable member 7*a* supported on the main assembly 2, and four developing devices on the rotatable member 7*a*, namely, developing devices 7M, 7C, 7Y and 7BK which contain magenta, cyan, yellow and black toners (developers), respectively. The developing devices 7M, 7C, 7Y and 7BK are sequentially moved to the developing position faced to the photosensitive drum 3 by the rotation of the rotatable member 7*a*, so as to develop the electrostatic latent image with proper color toner. When full-color copy is to be produced, the developing devices develop the electrostatic latent images once, respectively. Above the developing device 7, there are disposed four hoppers 7*b* for supplying the toners to the associated developing devices 7M, 7C, 7Y and 7BK.

Downstream of the developing device 7 in the direction of the rotational direction of the photosensitive drum 3, there is a transfer drum (recording material supporting member) 9. The transfer drum 9 is generally cylindrical, and is rotatably supported on the main assembly 2, and rotates in the direction of an arrow R2, in contact with the photosensitive drum 3.

Figure 2:
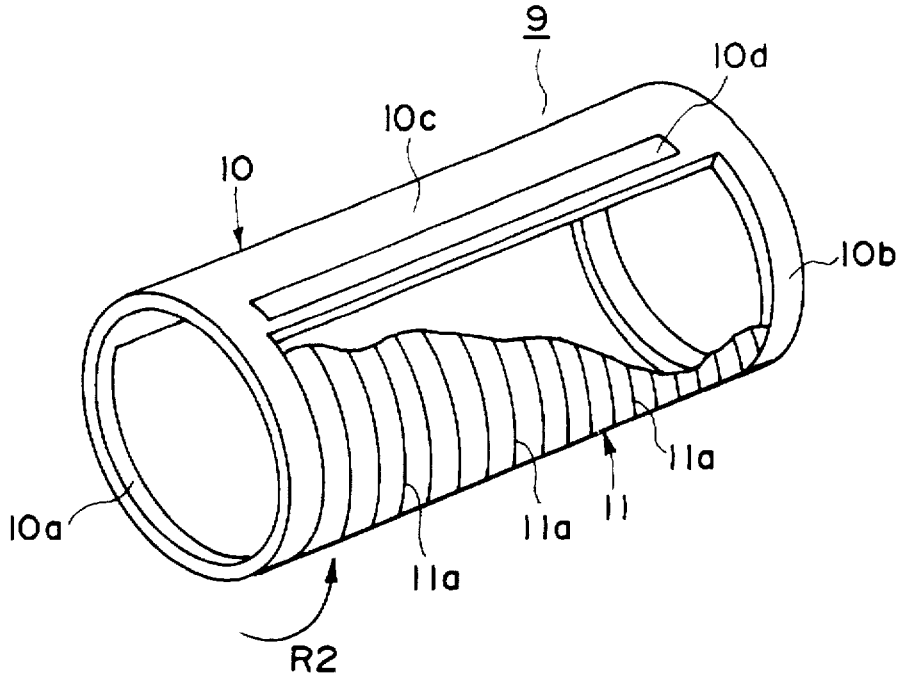
FIG. 2 is a partly exploded perspective view of a transfer drum.

Referring to FIG. 2, the detail of the transfer drum 9 will be described. The transfer drum 9 comprises a base member 10 made of metal or another electroconductive material, and a recording material carrying sheet 11. The base member 10 comprises a pair of ring members 10*a* and 10*b*, and a connecting portion 10*c* for partly connecting the cylindrical rings 10*a* and 10*b*, and recording material grippers 10*d* arranged along the length of the connecting portion 10*c*. They are integrally formed. The recording material gripper 10*d* is slightly raised from the connecting portion 10*c*, and the clearance provided thereby permits to receive the leading edge of the recording material P to grip it. The recording material carrying sheet 11 may be made of dielectric film such as polyethylene terephthalate, polyvinylidene fluoride resin film or the like. The recording material carrying sheet 11 is stretched to cover the substantially cylindrical portion defined by the cylinder portions 10*a* and 10*b* and the connecting portion 10*c*. A leading edge of the recording material carrying sheet 11 is fixed on the connecting portion 10*c*, and is wrapped around the cylinder portions 10*a* and 10*b*, and the trailing edge is fixed on the connecting portion 10*c* similarly to the leading end portion, at the neighborhood of the leading edge. Therefore, the outer peripheral surface of the transfer drum 9 is generally occupied by the recording material carrying sheet 11.

Figure 3:
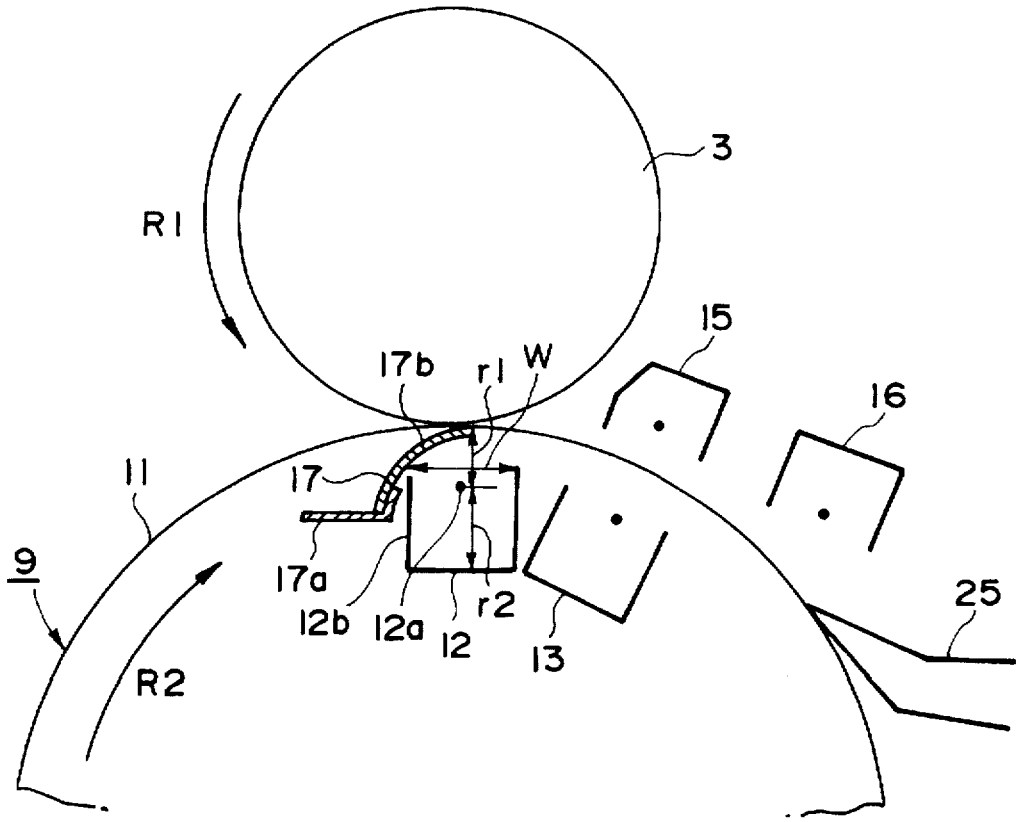
FIG. 3 is a sectional view of a major part of a transfer device.

At a position faced to the photosensitive drum 3 within the transfer drum 9, as shown in FIGS. 1 and 3, there is disposed a transfer charger (transfer device) 12. At the downstream neighborhood thereof, there are disposed an inside discharger 13, and two outside dischargers 15 and 16 in opposition thereto. Inside the transfer drum 9, there is a pressing member 17, which comprises an elastic sheet 17*b* having a base end fixed to a mounting base 17*a*. The elastic sheet 17*b* is smoothly curved, and the leading edge thereof is disposed at a downstream side with respect to a rotational direction of the transfer drum 9 (R2). The leading edge portion urges the inside surface of the recording material carrying sheet 11 to urge the recording material carrying sheet 11 onto the surface of the photosensitive drum 3. By doing so, the transfer efficiency of the toner image to the recording material P is improved to provide clear transferred image.

At a lower portion of the transfer drum 9, there is a cleaning device 18 (FIG. 1). The cleaning device 18 comprises a fur brush 18*a* for removing the residual toner from the surface of the recording material carrying sheet, and a cleaning assisting means 18*b* disposed inside the transfer drum 9. The fur brush 18*a* is rotated by an unshown driving means.

At a downstream side of the transfer drum 9 in the rotational direction of the photosensitive drum 3 (R1), a cleaning device 19 is disposed adjacent to the above-described primary charger 5. The cleaning device 19 has a cleaning blade 19*a* of elastic material. An end of the cleaning blade 19*a* is urged to the surface of the photosensitive drum 3, by which the residual toner is removed from the photosensitive drum 3.

The recording material feeding system will be described. In a feeding passage Ru for the recording material P, the recording material P is bottom right 2R portion of the main assembly 2, generally. The recording material P is fed to the transfer drum. After the toner images transferred by the transfer drum 9 or the like, it is discharged upwardly to the right side 2R away from the transfer drum 9.

In the most upstream side of the feeding passage Ru, sheet feeding cassettes 20, 20 stacking and accommodating different size recording materials, are detachably mounted to the right side surface 2R of the main assembly 2. Above the front end portion of the sheet feeding cassette 20, a sheet feeding roller 21 for supplying the recording material toward the feeding passage Ru from the sheet feeding cassette 20, is provided. Downstream thereof, there are feeding rollers 22 and registration rollers 23. The gripper 10*d* of the above-described transfer drum 9 grips the leading edge of the recording material P supplied from the registration rollers 23 to the transfer drum 9. When the transfer drum 9 rotates with the grippers 10*d* gripping the leading edge of the recording material P, the entirety of the recording material is wrapped on the recording material carrying sheet 11 of the transfer drum 9. At the upper right position of the transfer drum 9, there is separation claws for separating the recording material P from the transfer drum 9 after the toner image transfer operation, the claws 25 being disposed close to the surface of the photosensitive drum 9 at its free edge. Downstream thereof, there are a sheet feeding belt 26 for feeding the recording material P separated by the separation claws 25 to the fixing device 30 which will be described hereinafter, and sheet discharge tray 27 for receiving the sheet discharged after the fixing.

The fixing device 30 comprises a fixing roller 31 (fixing member) containing therein a heater 33, and a pressing roller 32 containing a heater 35. When the recording material P having the toner image passes through the nip between the rollers 31 and 32, the toner images are heated and pressed and fixed into a permanent image on the recording material P.

The full-color image formation process in the laser beam printer 1 will be described.

The photosensitive drum 3 is rotated in the direction R1, and the surface of the photosensitive drum 3 is uniformly charged by the primary charger 5. The thus charged photosensitive drum 3 is exposed to imagewise beam by a laser beam exposure device 6. At this time, first the magenta color image information is exposed, so that an electrostatic latent image for that color is formed. A magenta developing device 7M of the developing device 7 is presented to the photosensitive drum 3 to develop the electrostatic latent image into a visualized image of magenta color on the photosensitive drum 3.

The recording material P accommodated in the sheet feeding cassette 20 is fed out to the feeding passage Ru by the feeding roller 21. The recording material P is fed to the transfer drum 9 by the feeding rollers 22 and the registration rollers 23. The leading edge of the recording material P thus fed, is gripped by the recording material grippers 10*d*. With the rotation of the transfer drum 9 in the direction R2, it is closely wrapped on the surface of the transfer drum 9. The above-described magenta toner image is transferred onto the recording material P carried on the transfer drum. When the magenta toner image on the photosensitive drum 3 reaches to an image transfer zone where the photosensitive drum 3 and the transfer drum 9 are contacted, the toner image receives corona discharge of the opposite polarity by a transfer discharger 12 at the backside of the recording material carrying sheet, so that the toner image is transferred onto the recording material P supported on the transfer drum 9. Thus, the transfer of the magenta toner image is completed. Through the same process, cyan, yellow and black toner images are sequentially transferred onto the recording material P on the transfer drum 9, so that overlaid four color toner images are formed on the recording material.

The recording material P now having the four color toner images, are discharged by the inside and outside dischargers 13, 15 and 16, and is separated from the transfer drum 9 by separating claws 25. The separated recording material P is fed to the fixing device 30 by a conveying belt 26. Here, the toner image is heated and pressed and fixed into a permanent image on a recording material P. At this time, the fixing speed of the fixing device 30 is lower than the process speed of the main assembly 2 (160 mm/sec), at 90 mm/sec. This is done in order to apply to the toner sufficient amount of heat when two–four layered toner images are fused and fixed. By effecting the fixing operation at a lower speed than that of the photosensitive drum speed, the larger amount of heat can be applied to the toner. The recording material P on which the toner image is fixed, is discharged onto the discharge tray 27.

The toner used to form color image formation is required to display good fusibility and mixability when subjected to heat as contrasted to a monochromatic image formation. Therefore, toner having a sharp-melt characteristic, that is, having a low softening point and a low degree of melt viscosity, is used for this purpose (four layer toner). The use of such sharp-melt toner shows good fusing and mixing nature and can widen the color reproduction range and can offer a color copy which is faithful to an original of full-color, or which has two or more colors.

The sharp-melt toner is produced by fusing, kneading, pulverizing and classifying a mixture of binder resin material such as polyester resin or styrene-acrylic ester resin material or the like, coloring agent (dye, sublimating dye) and electrification control agent. As desired, the toner powdery may contain various materials such as hydrophobic colloidal silica.

From the standpoint of the fixing characteristics and the sharp melting characteristics, the color toner preferably uses polyester resin material as a binder resin material. The sharp melting polyester resin includes for example a high polymer having ester linkage in the principal chain of molecules synthesized from diol compound and dicarboxylic acid.

In view of sharp melting characteristics, particularly preferred resins may be polyester resins obtained through polycondensation of at least a diol component selected from bisphenol derivatives represented by the formula:

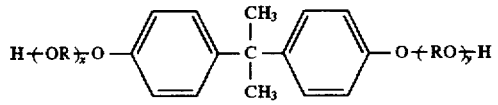

wherein R denotes an ethylene or propylene group; x and y are respectively a positive integer of 1 or more providing the sum (x+y) of 2 to 10 on an average and their substitution derivatives, and a two- or more-functioned carboxylic acid component or its anhydride or its lower alkyl ester, such as fumaric acid, maleic acid, maleic anhydride, phthalic acid, terephthalic acid, trimellitic acid, pyromellitic acid and mixtures thereof.

Figure 4:
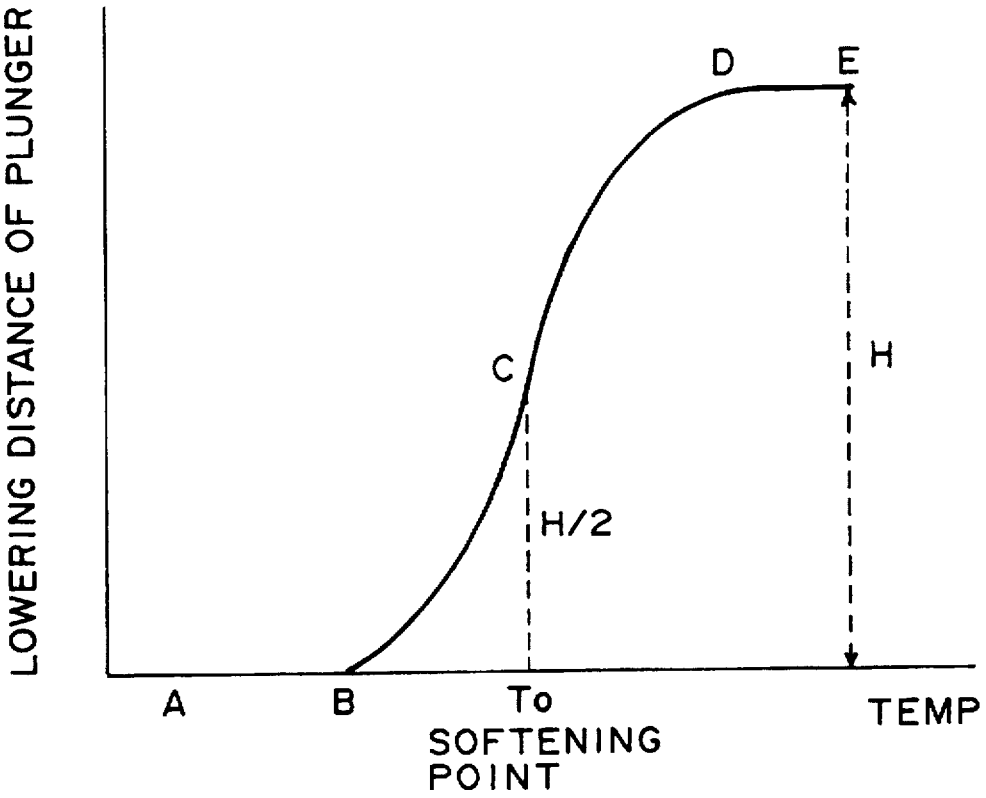
FIG. 4 shows the softening property of the toner having the sharp melting nature.

The softening point of the polyester resin is 75°–150° C., preferably 80°–120° C. FIG. 4 shows the softening characteristics of the toner containing the polyester resin as the binder resin. The measuring method of the softening point in this embodiment will be described.

A flow tester CFT-500A, available from Simazu Seisakusho, is used which has a die (nozzle) having a diameter of 0.2 mm and a thickness of 1.0 mm with the pressing load of 20 Kg. The initial temperature is set 70° C., and preliminary heating period is 300 sec. After the preliminary heating, the temperature is increased at the constant speed of 6° C./min. Then, the amounts of the plunger lowering are plotted relative to the temperature on the lowering amount vs. temperature curve (softening S curve). The weight of the toner is 1–3 g (precisely weighted) and the sectional area of the plunger is 1.0 $cm^2$. The softening S curve is as shown in FIG. 4. With the constant speed temperature increase, the toner is gradually heated, and it starts to flow (A–B). With further increase of the temperature, the fused toner flows out further (B–C–D) until the plunger lowering stops (D–E).

The height H of the S curve represent the total amount flown out, and the temperature T0 corresponding to the point C(H)/2 is the softening point of the material (toner).

Whether the toner and the binder resin have the sharp melt characteristics or not, can be determined on the measurement of the apparent fusing viscosity of the toner or the resin.

In this embodiment, the toner or the binder resin having the sharp melting characteristics means the toner satisfying the followings:

$$T1=90°-150° \text{ C.}$$

$$|\Delta T1|=|T1-T2|=5°-20° \text{ C.}$$

where T1 is the temperature at which the apparent fusing viscosity is $10^3$ poise, and T2 is a temperature at which it shows $5\times10^2$ poise.

The sharp melting resin material having such a temperature-viscosity characteristics is characterized by the sharp viscosity decrease when being heated. The viscosity decrease brings about the proper mixing between the topmost toner layer and the bottommost toner layer, the abrupt increase of the transparency of the toner layers themselves, and therefore, the subtractive color mixture properly occurs.

The sharp melting color toner has strong affinity, and therefore, the toner off-set tends to occur. Therefore, in the fixing apparatus for the image forming apparatus using such a color toner, high parting property is desired to last long.

Figure 5:
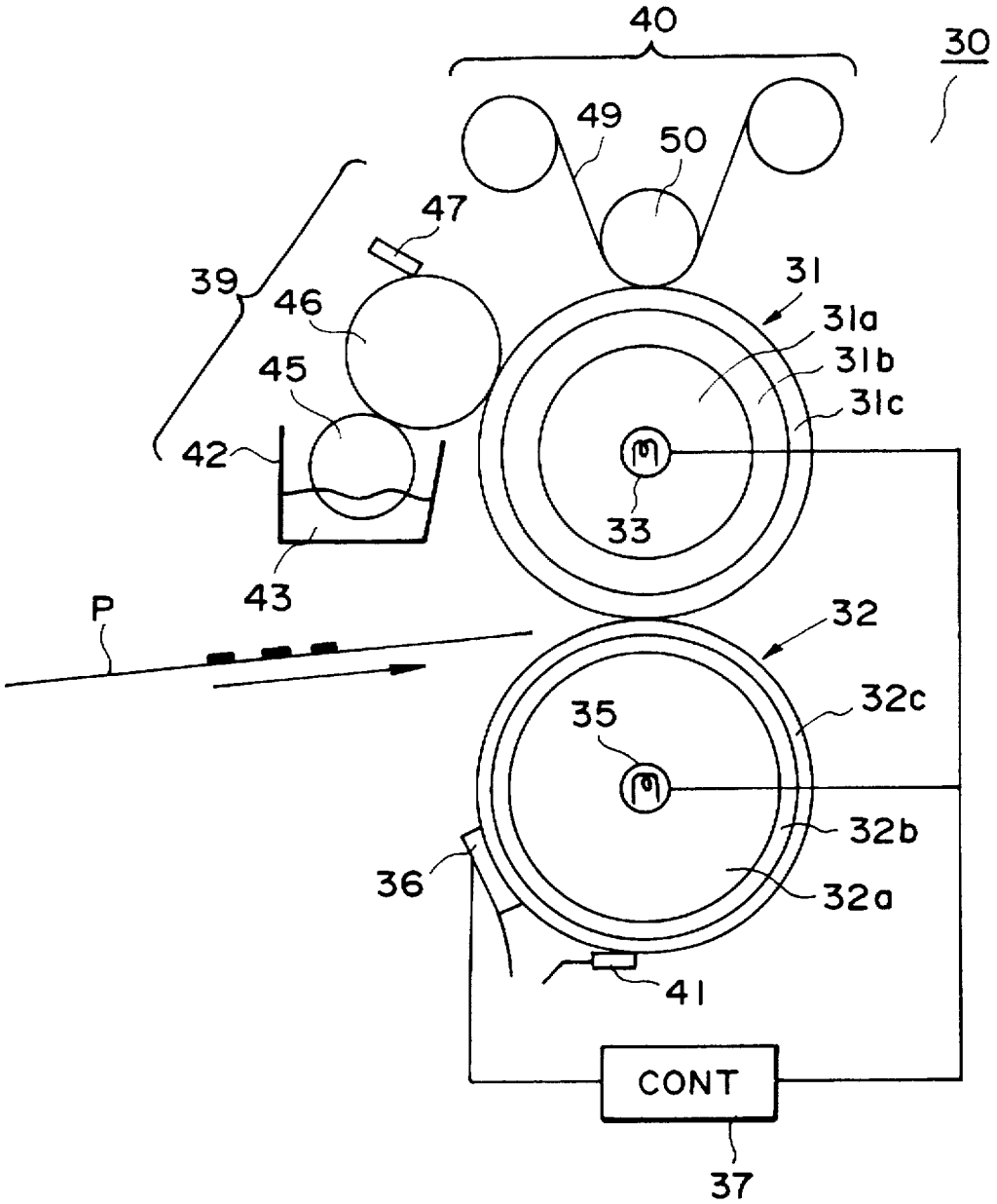
FIG. 5 is a sectional view of an image fixing apparatus.

Therefore, in the fixing device of a image forming apparatus such a color toner, it is preferable that the fixing roller exhibit high parting property for a long period of time. An image fixing device 30 of the full-color laser beam printer (image forming apparatus) 1 will be described. As shown in FIG. 5, the fixing device 30 comprises a fixing roller 31 and a pressing roller 32. The fixing roller 31 comprises an aluminum metal core 31*a*, HTV (high temperature vulcanization type) silicone rubber layer 31*b* on the metal core 31, and RTV (room temperature of vulcanization type) silicone rubber layer 31*c* thereon. The total thickness of the silicone rubber layers 31*b* and 31*c* is 3 mm, and the diameter of the entirety of the fixing roller 31 is 40 mm. On the other hand, the pressing roller 32 comprises an aluminum metal core 32*a*, an HTV silicone rubber layer 32*b* of 1 mm thick, and an RTV silicone rubber layer 32*c* thereon. The diameter of the entirety of the pressing roller 32 is 40 mm.

The fixing roller 31 comprises in the metal core 31*a* a halogen heater 33 (heating means), and the pressing roller 32 has in the metal core 32*a* a halogen heater 35. The recording material P is heated by the halogen heaters 33 and 35 at the opposite sides. As to the temperature control, a thermister 36 contacted to the pressing roller 32 is used to detect the temperature of the pressing roller 32. On the basis of the detected temperature, a control device 37 controls the temperatures of the halogen heaters 33 and 35 to maintain the temperatures of the fixing roller 31 and the pressing roller 32 at a constant temperature of approx. 170° C. The fixing roller 31 and the pressing roller 32 are pressed to each other at a total pressure of 40 kg by an unshown pressing mechanism.

In FIG. 5, upstream of the fixing roller 31 with respect to the feeding direction of the recording material P, an oil applicator 39 (parting agent applying means) is disposed. Above the fixing roller 31, a cleaning device 40 is disposed. Below the pressing roller 32, a cleaning blade 41 is disposed to remove oil contamination from the pressing roller 32. The oil applicator 39 takes the oil by an oil pick-up roller 45 in an oil pan 42 containing dimethylsilicone oil 43 (parting agent, available from Shinetsu Kagaku Kogyo Kabushiki Kaisha, KF96, 300cs). The oil is applied to an oil applicating roller 46. The amount of the oil application on the oil applicating roller 46 is regulated by an oil application adjusting blade 47, and thereafter, a proper amount of oil is applied on the fixing roller 31. The oil applicator 39 shown in FIG. 5 applies 0.08 g/A4 oil to the recording material P (measurement method will be described hereinafter).

The oil application amount by the oil applicator 39 is determined in the following manner. The weight of 50 plain A4 size sheets are prepared (A1 (g)). These sheets are passed through the nip between the fixing roller 31 and the pressing roller 32 without image transfer and without oil application to the fixing roller 31, and then, B (g) is provided as the weight of the 50 sheets. Another 50 A4 size plain sheets are prepared (A2 (g)). These sheets are processed without image transfer and with application of oil 43 to the fixing roller 31, and then the weight C (g) results. The oil application amount per A4 size sheet is obtained by:

$$X=(C+A1-B-A2)/50$$

On the other hand, the cleaning device 40 cleans the fixing roller 31 by urging by a pressing roller 50 an unwoven wave 49 (NOMEX, trade name). The wave 49 is wound up by a winding device (not shown) at proper intervals to prevent accumulation of the toner or the like at the contact portion.

In the foregoing, toner image formation on one side of the recording material P has been described in connection with full-color (four color) laser beam printer (image forming apparatus) 1. The apparatus is capable of forming images on both sides of the recording material P.

A toner image is transferred onto a front side of the recording material P, and the toner image is fixed by the fixing device 30. Then, it is refed to the main assembly of the recording apparatus, and then, another image is formed on the opposite side. Alternatively, after the image is fixed on the front side of the recording material, the operator may reverse the recording material to reset it in the cassette. Automatic reversing means may be used. Anyway, the recording material is refed to the transfer position to form the image on the backside thereof, thereafter.

When the image formation is carried out on each of the sides of the recording material P, the first side of the recording material P is deposited by the parting agent 43 during the first side copying operation. The deposition of the parting agent is not a problem if the image is not formed on the second side. However, when the image is formed on the second side, and when the recording material P is wrapped on the surface of the transfer drum 9 for the purpose of receiving the toner image, the first side of the recording material P, that is, the surface having the parting agent 43 as a result of the first copy operation, is contacted to the surface of the transfer drum 9. Therefore, the parting agent 43 is deposited on the surface of the transfer drum 9. Conventionally, when the recording material P is away from the transfer drum 9 thereafter, the parting agent 43 on the transfer drum 9 is deposited to the surface of the photosensitive drum 3 contacted to the transfer drum 9. The unnecessary toner is deposited to the parting agent 43 on the photosensitive drum 3, and the toner is deposited on the subsequent recording material P with the result of image contamination or another deterioration of the quality of the image.

In this embodiment, the transfer drum 9 is improved to avoid the problem. The transfer drum 9 comprises a base member 10 made of electrically conductive material such as metal. The base member 10 comprises two cylinder portions 10*a* and 10*b* and a connecting portion 10*c* for connecting the cylinder portions. The transfer drum 9 further comprises a recording material carrying sheet 11 stretched into a cylindrical form. The recording material carrying sheet 11 is of dielectric sheet having high parting property and having a thickness of 25–2000 μm, preferably 70–200 μm, made of polyvinylidene fluoride resin (PVdF) film or the like. The leading and trailing edges thereof are fixed on the connecting portion 10*c*.

In this embodiment, the diameter of the transfer drum 9 is 160 mm, and the moving speed is 160 mm/sec. The process speed which is the moving speed of the photosensitive drum 3 is 160 mm. The transfer charger 12 is in the form of a corona charger having a discharging wire 12*a* (FIG. 3) and a shielding plate 12*b*. A width of an opening of the shielding plate 12*b* is 19 mm (W), and the distance between the discharging wire 12*a* and the surface of the photosensitive drum 3 is 10.5 mm (r1). The distance r between the discharging wire 12*a* and the bottom surface of the shielding plate is 16 mm. The transfer charger 12 is supplied with +4–+10 KV, and the transfer current is +25–+500 μA.

Figure 6:
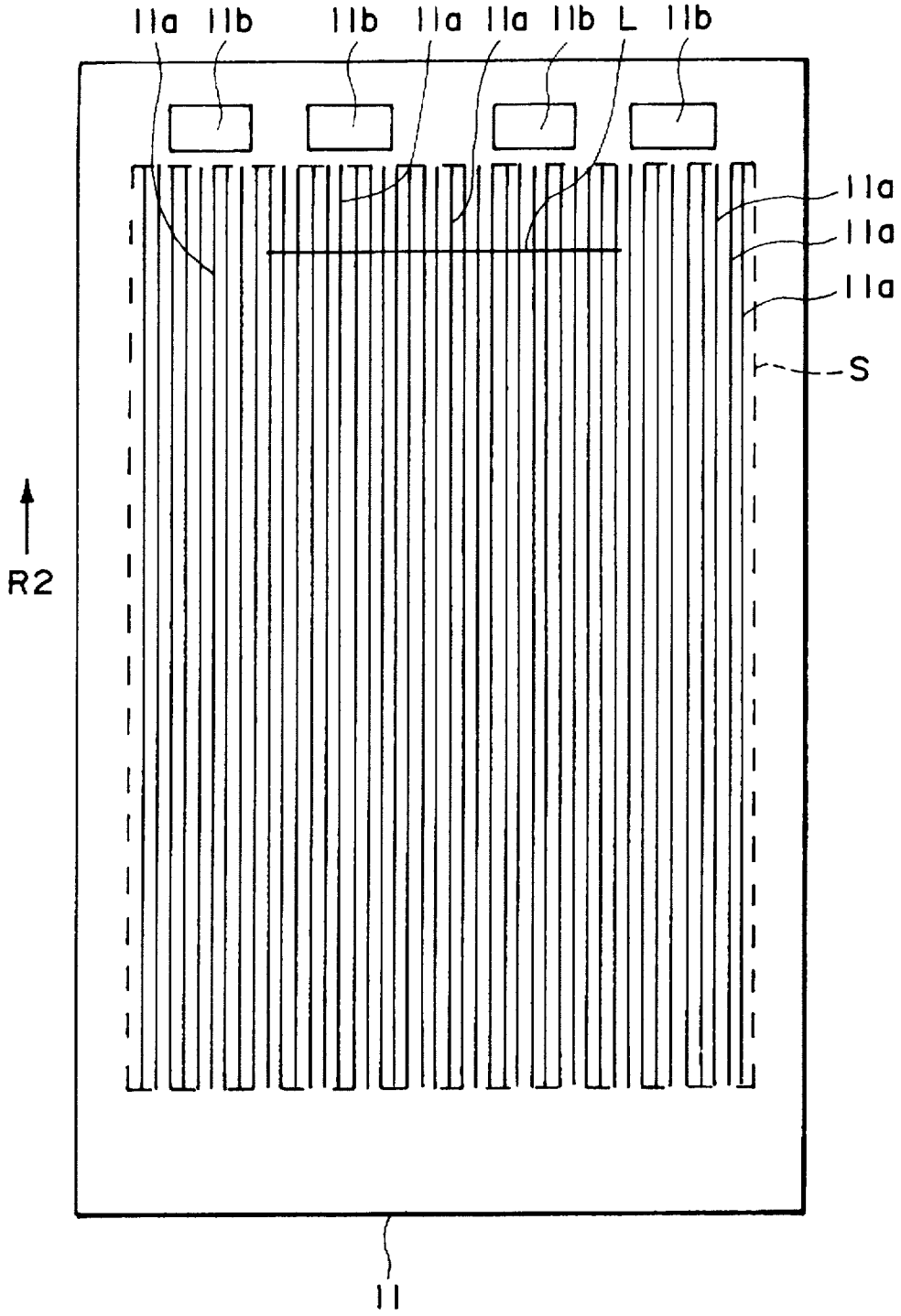
FIG. 6 is an expanded view of a recording material carrying sheet.

FIG. 6 is an expanded view of the recording material carrying sheet occupying almost all outer peripheral part of the transfer drum 9, as seen from the photosensitive drum 3 (outer peripheral surface). Therefore, when the toner image is to be transferred from the photosensitive drum 3 to the recording material P, the recording material carrying sheet carries the recording material P on the outer peripheral surface shown in FIG. 6. More particularly, the recording material P gripped at its leading edge by grippers 10*d* of the transfer drum 9, is wrapped on the recording material carrying sheet so as to be closely contacted to the outer peripheral surface thereof, in a region S enclosed by broken line in the Figure. Four holes 11*b* above the zone S are used to mount the recording material grippers 10*d*.

The zone S of the recording material carrying sheet 11 is provided with a number of fine recesses 11*a*, 11*a*. The fine recesses 11*a* are arranged in the form of grooves along a movement direction of the transfer drum 9 (R2 direction, which is the same as the rotational direction). By doing so, the surface roughness of the zone S is increased. The degree of the surface roughness is 7–20 μm, preferably 10–15 μm in ten point average roughness Rz along a line L crossing the fine recesses 11*a* substantially perpendicular, which will be hereinafter called Rz, and not more than 30 μm, preferably not more than 20 μm in average peak intervals Sm, which will hereinafter be called Sm. The maximum roughness Rmax is not more than 30 μm, preferably not more than 20 μm from the standpoint of preventing improper image transfer due to local strong transfer electric field. The surface roughness is measured in the following manner.

The measuring device is a surfcoder SE-30AK, available from Kosaka Kenkyusho Kabushiki Kaisha, Japan is used with non-contact detecting unit PS-100U. The measured length is 2.5 mm, the vertical magnification is 2000, the horizontal magnification is 100, a cut-off is 0.8 mm, and phase compensation R+w type is used.

Figure 7:
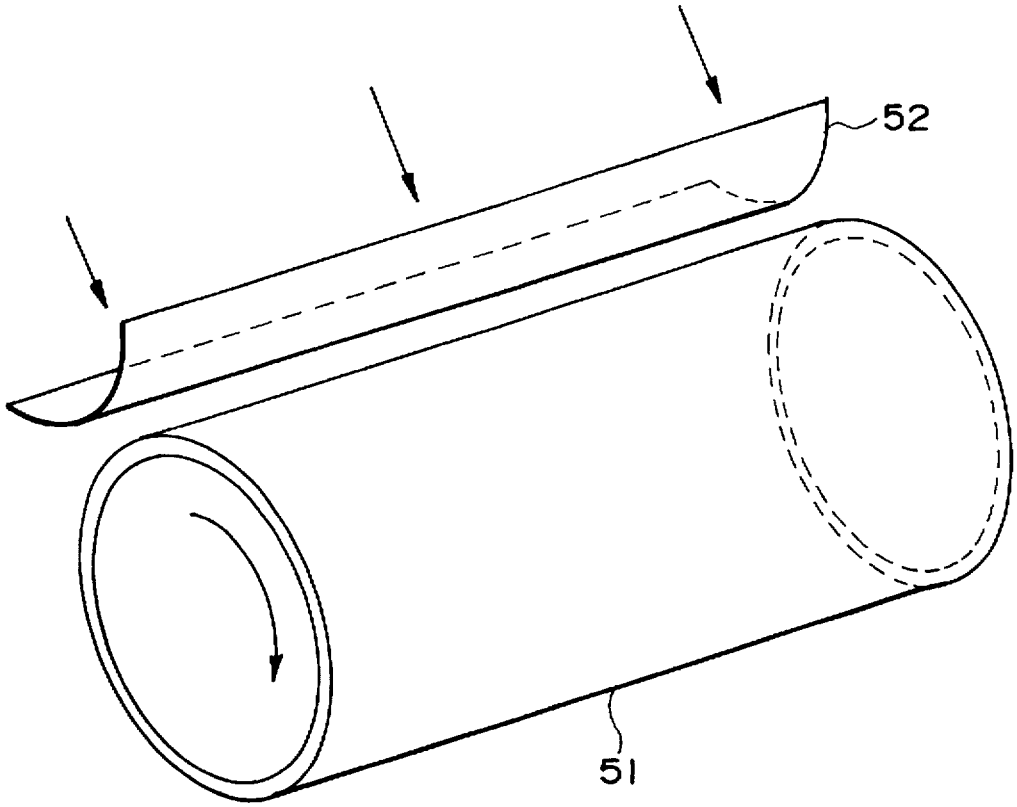
FIG. 7 is a perspective view of a method for roughening the recording material carrying sheet.

As for the method of roughening the surface of the recording material carrying sheet, as shown in FIG. 7, a recording material carrying sheet 11 is wrapped on a cylindrical drum 51 having a diameter of approx. 160 mm, and the drum 51 is rotated at several rpm, and #2000 sand paper 52 is brought into or brought out of contact with the recording material carrying sheet 11. While repeating this, the drum 51 is rotated 10–20 rotations, by which the surface roughnesses Rz, Sm and Rmax in the zone of FIG. 6 come to satisfy the above-described conditions.

If the simple roughening of the zone S of the recording material carrying sheet 11 is satisfactory, sandblasting method may be used. However, the recording material carrying sheet 11 for the above-described laser beam printer 1, is contaminated at its surface by fog toner or scattered toner, and therefore, the recording material carrying sheet 11 is desirably cleaned by fur brush 18*a* (FIG. 1) or the like. Therefore, the fine recesses 11*a* are desirably arranged along the movement direction of the recording material carrying sheet (R2 in FIG. 6). Then, the recording material carrying sheet 11 is effectively cleaned, and therefore, the problem of the contamination of the backside of the recording material P can be avoided. Therefore, the above-described method is preferable rather than sandblasting method. By doing so, the fine recesses 11*a* are along the movement direction of the recording material carrying sheet 11. The thickness of the fiber of the fur brush 18*a* is preferably smaller than the average peak intervals Sm from the standpoint of the better cleaning.

In the conventional apparatus, at the time of the both side copying operation, the parting agent (oil) 43 is deposited to the first side of the recording material at the time of the toner image fixing operation. Subsequently, when the copy image is formed on the second side of the recording material P, the first side having the parting agent 43 is closely contacted to the recording material carrying sheet 11, with the result that the parting agent 43 is transferred onto the recording material carrying sheet. If the recording material carrying sheet on which the parting agent 43 is deposited is contacted directly to the photosensitive drum during post-rotation which is a rotation of the transfer drum after toner image transfer or pre-rotation which is rotation immediately before the next image formation, the parting agent 43 on the recording material carrying sheet 11 is retransferred onto the photosensitive drum 3, by which, the improper image formation results in the subsequent recording material P.

However, by using the roughened surface of the recording material carrying sheet, the improper image attributable to the parting agent 43 on the photosensitive drum 3 can be effectively prevented.

The reason for this is considered as follows. The roughening the recording material carrying sheet 11 to the above-described extent, even if the recording material P having the parting agent 43 on its surface is contacted to the recording material carrying sheet 11, the absolute amount of deposition of the parting agent 43 on the recording material carrying sheet 11 is significantly reduced because the contact area between the recording material P and the recording material carrying sheet 11 is reduced. In addition, even if the parting agent 43 is transferred onto the recording material carrying sheet 11, the parting agent 43 enters the fine recesses (Rz=7–20 μm) 11*a*, since the surface of the recording material carrying sheet 11 is roughened with small pitch (Sm=not more than 30 μm). Therefore, when the recording material carrying sheet 11 is contacted to the photosensitive drum 3, the amount of re-transfer to the photosensitive drum 3 is significantly reduced. Therefore, the amount of parting agent 43 onto the photosensitive drum 3 significantly reduces, thus effectively avoiding the improper image formation attributable to the transfer of the parting agent 43 to the photosensitive drum 3.

The parting agent 43 in the fine recesses 11*a* of the recording material carrying sheet 11 is sequentially removed by the fur brush 18*a* of the cleaning device 18, and therefore, there occurs no problem.

The description will be made as to a second embodiment of the recording material carrying sheet. The same reference numerals are assigned as in the first embodiment to the elements having the corresponding functions, and the detailed description thereof are omitted for simplicity.

Figure 8:
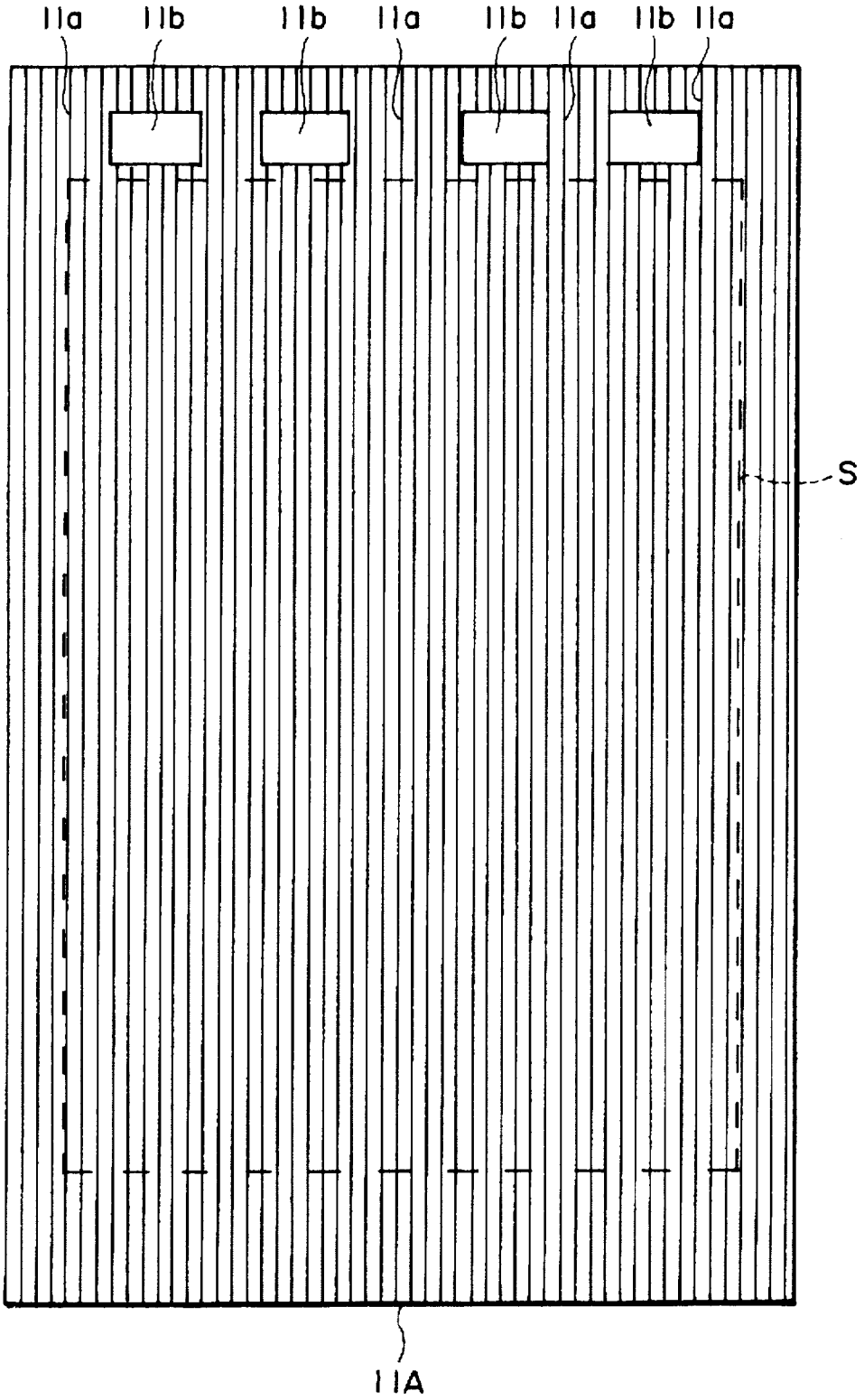
FIG. 8 is an expanded view of a recording material carrying sheet, according to a second embodiment of the present invention.

In this embodiment, the fine recesses or pits 11*a* are formed outside the zone S, as shown in FIG. 8, and therefore, the whole surface is roughened. This is different from Embodiment 1.

Figure 9:
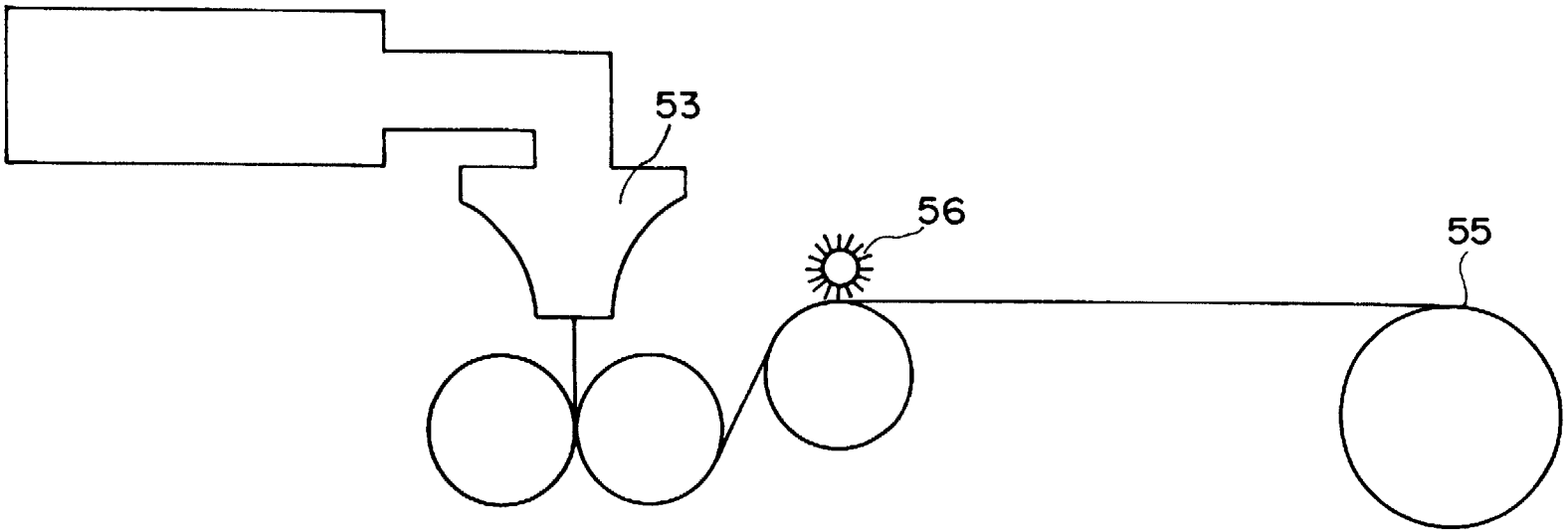
FIG. 9 is a schematic view illustrating a method of roughening the surface of the recording material carrying sheet according to the second embodiment of the present invention.

As for the method of roughening the recording sheet 11*a*, the following method is used. Referring to FIG. 9, the recording material carrying sheet is formed by extruder having T-shaped die 53 shown in FIG. 9. In this embodiment, between the die 53 and a sheet winding portion 55, a roughening member 56 is provided which has a cylindrical brush of fiber diameter of several microns—several tens microns and a length of several mm—several tens mm, and made of metal such as brass or SUS or resin material having equivalent hardness. The recording material carrying sheet extruded from the die 53 is roughened by the roughening member 56 rotating at a speed of 1000–2000 rpm on the way to the sheet finding up portion 55. After it is wound up, it is cut-into the form shown in FIG. 8. The image forming operation was carried out using the recording material carrying sheet 11A having been roughened to the same degree as in the first embodiment. It has been confirmed that similarly to Embodiment 1, the amount of the parting agent deposited on the photosensitive drum 3 can be reduced during both side copying operation, and the occurrence of improper image formation can be prevented.

By using this roughening method, substantially the same advantageous effects as in the first embodiment can be prevented, and in addition, the time and cost required for the roughening is significantly reduced. Therefore, the cost of the entire apparatus could be reduced.

Figure 10:
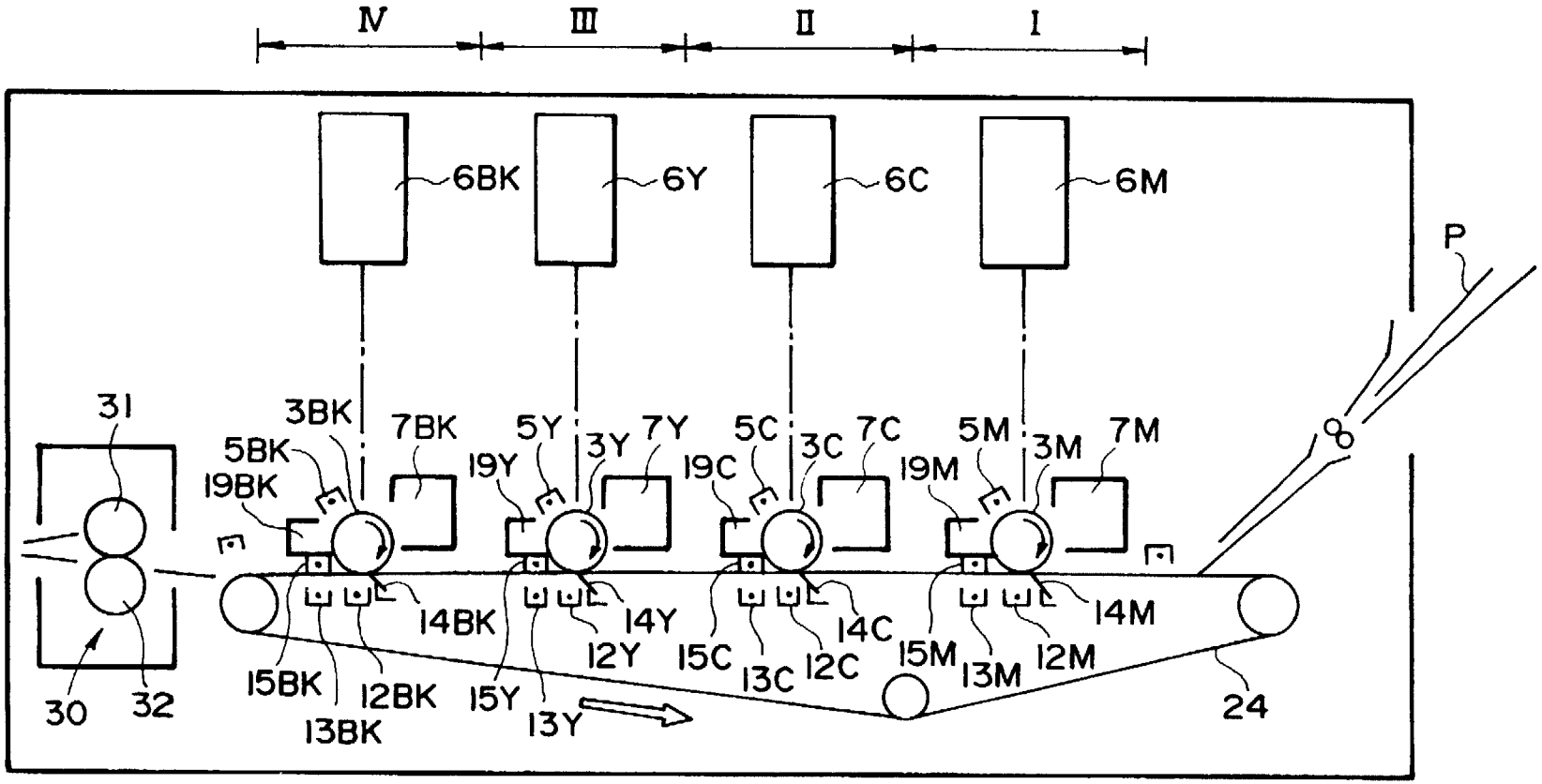
FIG. 10 is a sectional view of an image forming apparatus according to a third embodiment of the present invention.
Figure 11:
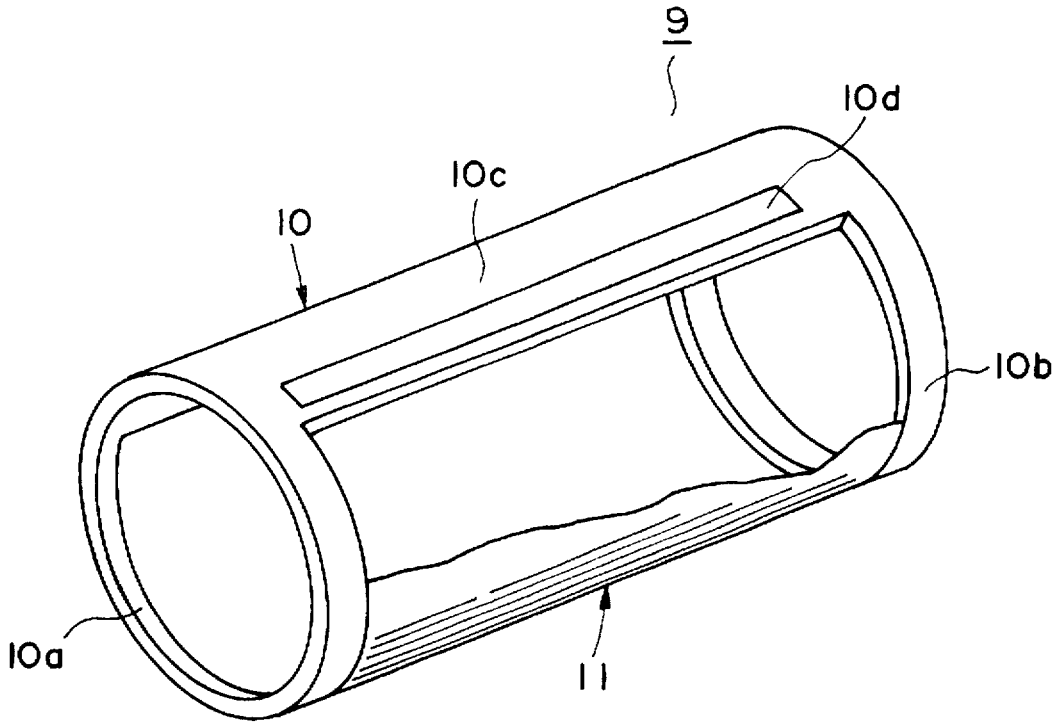
FIG. 11 is a perspective view of a transfer drum.

The present invention is widely applicable to a multicolor electrophotographic copying apparatus shown in FIG. 10, having four image formation units I, II, III and IV.

In this embodiment, each of the image forming units I–IV, comprises a photosensitive drum 3M, 3C, 3Y or 3BK, and around the photosensitive drum, there are provided a primary charger 5M, 5C, 5Y or 5BK, exposure means 6M, 6C, 6Y or 6BK, a developing device 7M, 7C, 7Y or 7BK, a transfer discharger 12M, 12C, 12Y or 12BK, dischargers 13M, 13C, 13Y or 13BK and 15M, 15C, 15Y or 15BK, a cleaner 19M, 19C, 19Y or 19BK. An endless sheet conveying belt 24 (recording material carrying member) penetrates through the image forming units I–IV below the photosensitive drums 3M, 3C, 3Y and 3BK.

On the other hand, in the discharging region of each of the transfer dischargers 12M, 12C, 12Y and 12BK, there are urging members 14M, 14C, 14Y and 14BK to urge the conveyer belt 24 to the photosensitive drums.

In this embodiment, the surface of the conveyer belt 24 is roughened to the same degree as in Embodiment 1 and 2. The image forming operations were carried out using such roughened conveyer belt 24, and it was confirmed that the improper image formation can be prevented as in Embodiments 1 and 2.

The description will be made as to the Embodiment not using the recesses or pits but effective to prevent the deposition of the parting agent onto the photosensitive drum. The transfer drum as shown in FIG. 2 is usable.

Figure 12:
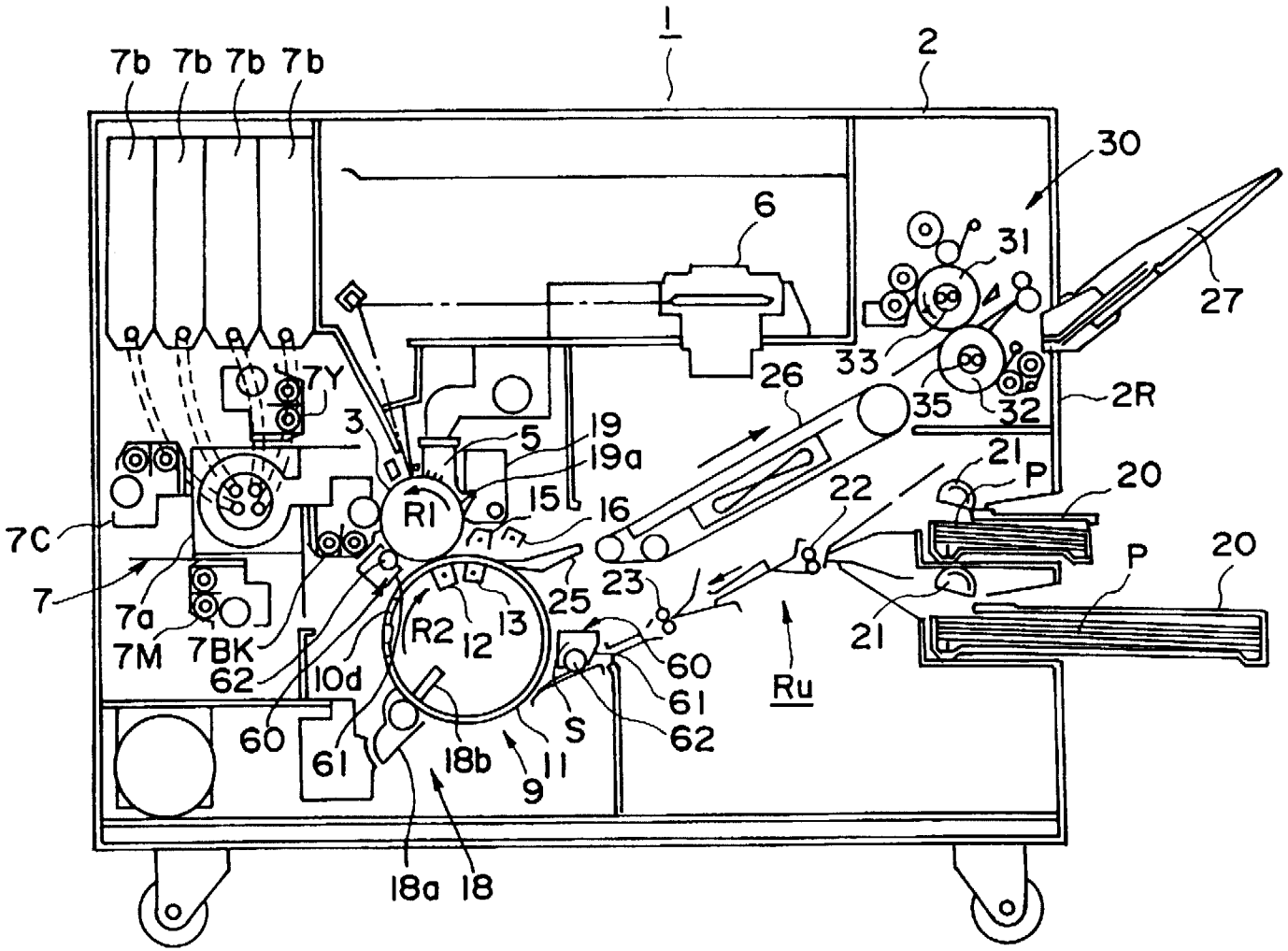
FIG. 12 is a sectional view of an image forming apparatus.

As shown in FIG. 12, the laser beam printer 1 is similar to that of FIG. 1, but the printer of this embodiment is provided with a spacer particle applicator (spacer particle applicating means) 60 to provide the spacer particles S between the recording material P and the transfer drum (recording material supporting member) 9.

The spacer particle applicator 60 comprises a container 61 for containing the spacer particles S, and an application roller 62 for directly applying the spacer particles S to the recording material P. The application roller 62 may be rotated by the recording material P, or may be independently positively rotated by an unshown driving means. The entirety of the spacer particle applicator 60 is disposed so that the application roller 62 is brought into contact to the top surface of the recording material P in the feeding path Ru between the registration roller 23 and the transfer drum 9. Therefore, the spacer particles S are applied to the top surface of the recording material P being supplied to the transfer drum 9, namely, the surface which is going to contact the transfer drum 9 when it is wrapped on the transfer drum 9.

The usable materials for the spacer particles S include, fluorocarbon, alumina, titanium oxide, selenium oxide, aluminum hydride, calcium carbonate, silica, PVdF, activated carbon, toner for image formation or the like. The preferable particle size is 0.05–20 μm. It is preferably chargeable triboelectrically. In this case, a stirring or charging member may be provided in the container 61, so that proper amount of electric charge is applied to the particles. Then, the spacer particles S are stably deposited by the electrostatic force on the recording material P by the application roller 62. By such an spacer particle applicator 60, the spacer particles S are applied uniformly on the recording material P with 1–20 μm layer thickness. When the both side copy operation is carried out for a recording material P, the improper image formation attributable to the parting agent 43 on the photosensitive drum 3 can be avoided.

The reason is considered as follows. In the conventional apparatus, at the time of duplex copy operation, when the recording material passes through the fixing device 30, the parting agent 43 such as silicon oil is deposited to the image surface of the recording material for the purpose of preventing the toner offset to the fixing roller 31. The parting agent 43 on the recording material is deposited to the transfer drum 9 by the direct contact between the recording sheet 11 and the transfer drum 9 during the next side image formation. In this embodiment, the surface of the recording material P is coated with the spacer particles 8, by which the parting agent 43 deposited on the recording material P is not directly contacted to the recording material carrying sheet, and therefore, the deposition of the parting agent 43 to the recording material carrying sheet 11 can be effectively prevented. For this reason, there is no parting agent 43 transferred and deposited from the recording material carrying sheet 11 onto the photosensitive drum 3. Therefore, the improper image formation such as contamination of the subsequent recording sheet P, attributable to the deposition of unnecessary toner and the parting agent 43 on the photosensitive drum 3, can be avoided.

As to the layer thickness of the spacer particles S on the recording material P, if it is not larger than 1 μm, the parting agent preventing effect is not sufficient, and if it is larger than 20 μm, the strength of the transfer electric field is enough in the both side image forming operation, with the result of poorer image transfer, and therefore, it is preferably 1–20 μm.

In this embodiment, the application of the spacer particles S is carried out normally during image formation. However this is not imperative. For example, both side (duplex) mode selector switch may be provided at an operation panel (not shown) of the main assembly 2 of the apparatus, and in the both side mode, the operator of the laser beam printer may actuate the switch. By doing so, the duplex mode is detected both hand. When the duplex mode is detected, the spacer particle application is carried out. By doing so, the wasteful consumption of the spacer particles S can be avoided. This is preferable. In addition, the duplex mode may be detected using parting agent detecting means or the image detecting means provided in the conveying passage Ru or the sheet feeding station. Thus, it is automatically detected whether the duplex mode is selected or not. In this manner, the application of the spacer particles S can be automatically controlled.

Figure 13:
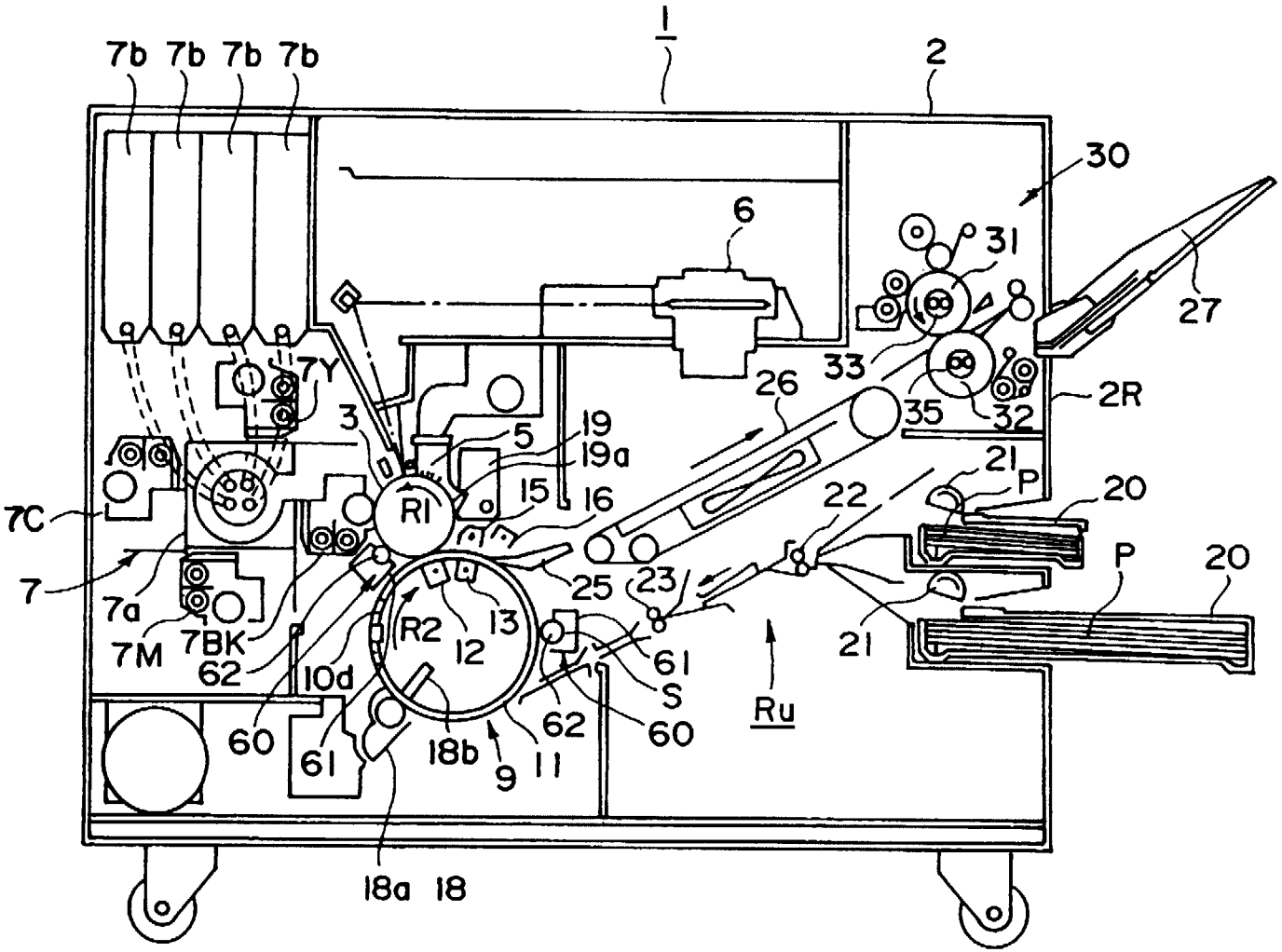
FIG. 13 is a sectional view of an image forming apparatus.

In this embodiment, the spacer particles S are applied to the recording material P. As another embodiment, as shown in FIG. 13, the spacer particles S may be directly applied on the recording material carrying sheet 11 of the transfer drum 9.

The spacer particle applicator 60 is disposed adjacent the outer peripheral surface of the photosensitive drum 9 and slightly downstream of the separation claws 25, for example. The application roller 62 is contacted to the recording material carrying sheet 11 of the transfer drum 9 to directly apply the spacer particles S to the recording material carrying sheet 11.

In the embodiment, when the image forming apparatus (laser beam printer) 1 starts a series of image forming operations, and the transfer drum 9 starts the prerotation for the image formation, the spacer particle applicator 60 is operated and controlled so that the spacer particles S are applicated on a region of the recording material carrying sheet 11 that is going to carry the recording material P, in synchronism with the movement of the recording material P.

By doing so, in this embodiment, similarly to the foregoing embodiments, the deposition of the parting agent 43 onto the transfer drum 9, and therefore, the improper image formation can be avoided.

A further embodiment will be described in which the developing device 7 is operated during a preliminary operation for the actual image forming operation in the laser beam printer 1 shown in FIG. 1, so that a toner layer functioning as spacer article layer is formed on the photosensitive drum 3. The toner layer is directly transferred onto the recording material carrying sheet 11, and after the toner layer is formed on the recording material carrying sheet 11, the recording material P is carried on the recording material carrying sheet 11. The description will be made as to the operations of the primary charging, image exposure, developing unit movement, developing device actuation and the transfer charging, will be described. The operations are on the basis of the rotation of the transfer drum. The description will be made referring to FIG. 14 which is a timing chart. An A4 size sheet is used as the recording material P.

When the image forming operation starting switch is actuated, the photosensitive drum 3 and the transfer drum 9 start to rotate. In order to form a toner layer on the recording material carrying sheet, corona discharging action is carried out by the primary charger 5 to uniformly charge the surface of the photosensitive drum 3. A laser beam sufficient to deposite an amount of toner which is not more than approx. one tenth of the maximum image density in the normal image forming operation, is applied for the period corresponding to the width of A4 size sheet, so that such a latent image is formed on the photosensitive drum 3. At the developing position, the magenta developing device 7M is at the stand-by position after the completion of the previous image forming operation. It starts to developing operation to visualize magenta image. In the operation of the developing device, it is actuated t earlier than the image front in the developing position in consideration of the time t required for the developing sleeve to reach the constant rotational speed.

At the transfer position, the transfer discharger 12 is operated in timed relation with the toner image formed on the photosensitive drum 3 to form a magenta toner layer directly on the recording material carrying sheet 11. Thereafter, on the recording material carrying sheet 11, the recording material fed from the sheet feeding cassette 20 is carried at the position where the magenta toner layer is formed. Subsequently, a latent image for magenta color is formed by a laser beam modulated in accordance with image information, and the latent image is developed into a toner image. Then, the image is transferred onto the recording material P at the transfer position. This step is repeated for cyan image, yellow image and black image. In this embodiment, the spacer particles S are toner particles. The spacer particle applicator 60 is the developing device 7. Thus, the developing device 7 is actuated at the above-described timing to provide a toner layer as a spacer particle layer, thus a thin layer of the toner is formed on the recording material carrying sheet 11.

Using such structure, the copying operations were carried out onto the both sides of the recording material P. It has been confirmed that similarly to the foregoing embodiments, the deposition of the parting agent 43 on the recording material carrying sheet can be effectively prevented, and therefore, the improper image formation can be avoided.

In this embodiment, the toner layer is formed on the recording material carrying sheet 11. However, the spacer particle applicator 61 as in the foregoing embodiment may be provided adjacent the developing device 7 or adjacent the surface of the photosensitive drum 3, so that the spacer particle layer is formed on the recording material carrying sheet 11.

The description will be made as to a further embodiment in which the spacer particle layer is provided on the image bearing member surface to prevent the deposition of the parting agent to the image bearing member. In this embodiment, the spacer particle layer may be formed also between the recording material carrying sheet and the recording material, in addition to the spacer particle layer formed on the surface of the image bearing member.

In this embodiment, during the series of image forming operations, the toner layer functioning as the spacer particle layer can be always formed on the photosensitive drum 3, when the recording material is not carried on the transfer drum 9, that is, when the photosensitive drum 3 and the recording material carrying sheet 11 of the transfer drum 9 are directly contacted.

Figure 15:
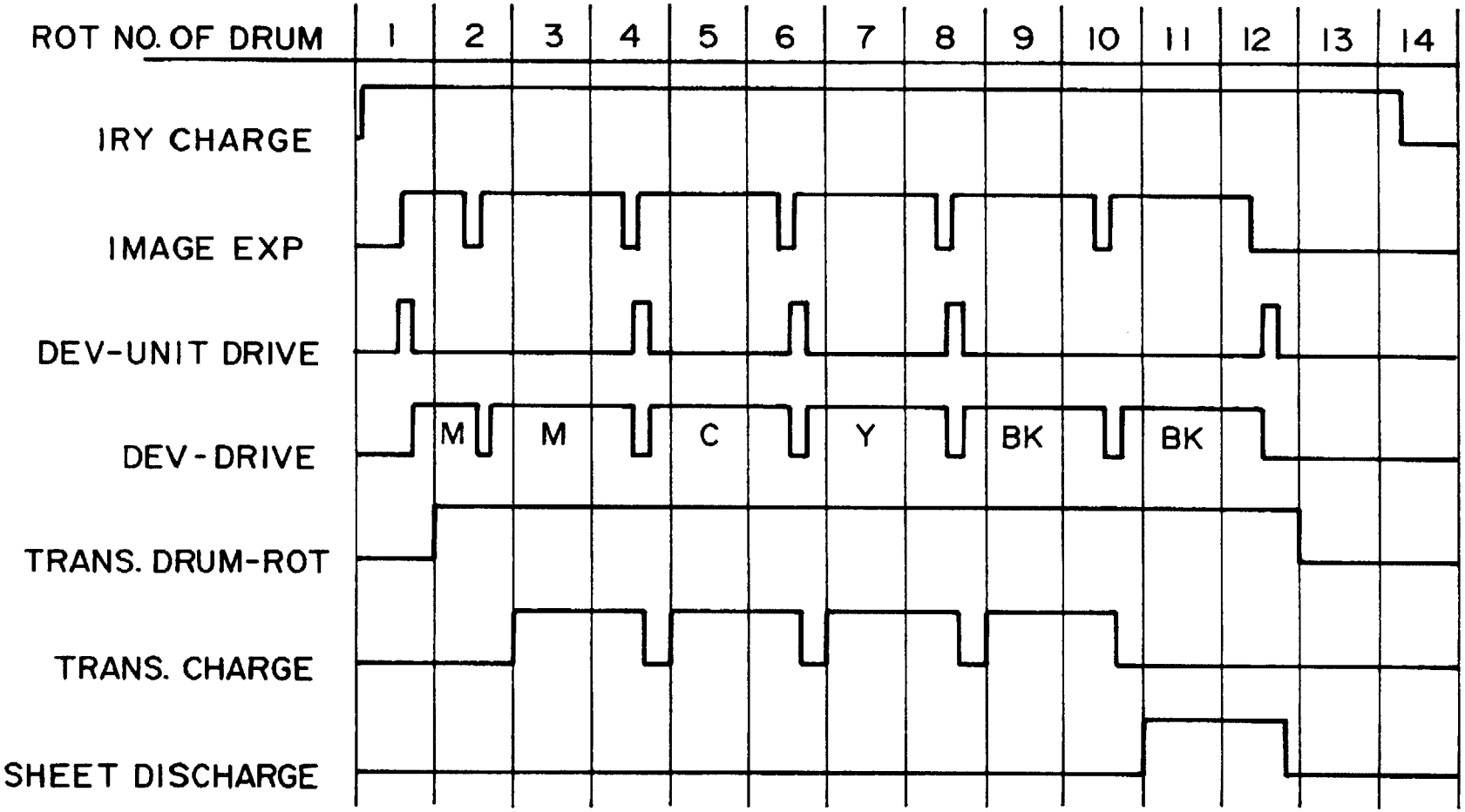
FIG. 15 is a timing chart of various operations of an image forming apparatus.

Referring to FIG. 15 which is a timing chart, the operations of primary charging, image exposure, developing unit movement, developing device actuation, rotation of the transfer drum, transfer charging and the discharging of the recording material carrying sheet, which are effected on the basis of the rotation of the photosensitive drum 3, will be described. The toner image is transferred onto a recording material P of A4 size.

Upon image formation start signal, the photosensitive drum 3 starts to rotate, and the corona discharging operation is carried out by the primary charger 5 to uniformly charge the surface of the photosensitive drum 3. In the developing position, the magenta developing device 7M moves from the rest home position to the developing position. The photosensitive drum 3 is exposed to a laser beam capable of depositing approx. 1/10 or less amount of toner required for providing the maximum image density in the normal image formation, so that the latent image is formed on the entire surface of the photosensitive drum 3. The magenta developing device 7M is operated to effect the developing operation to form the toner image on the photosensitive drum 3. After the start of the toner image formation, and when the toner image on the photosensitive drum 3 substantially reaches the transfer position, the transfer drum 9 starts to rotate. At a position on the transfer drum which is diametrically opposite from the transfer position, the recording material P already supplied the passage Ru from the sheet feeding cassette 20, is carried on the recording material carrying sheet substantially simultaneously with start of rotation of the transfer drum 9, so that it is carried to the transfer position.

In the developing position, the photosensitive drum 3 is developed through one-full turn thereof, and thereafter, the magenta developing device 7M does not move and prepared for the next magenta image development. In the exposure position, after the laser application for one-full turn of the photosensitive drum, the latent image is formed by the modulated laser beam in accordance with the magenta image information with a delay of time corresponding to about 1/5 rotation of the photosensitive drum 3. The latent image is developed with the magenta toner of the magenta developing device 7M rested in the developing position. The toner image is transferred onto the recording material carried on the recording material carrying sheet by the transfer charger 12 at the transfer position. After the development of the magenta image, the magenta developing device 7*n* moves quickly in the developing zone, and the cyan developing device 7C is placed in the developing position to effect the next cyan image development. The cyan, yellow and black toner images are transferred onto the recording material P through the similar methods, and thereafter, the recording material P is separated from the transfer drum 9 to the fixing device 30. Then, the toner image is fixed by heat into a permanent toner image. The transfer drum 9 rotates further one rotation after the transfer of the black image, so that the electric charge remaining on the recording material carrying sheet is discharged by AC corona discharge of the dischargers 13 and 15.

In the developing position, the black developing device 7BK does not move but space in the developing position, even after the completion of the black toner image development. In the exposure position, after the exposure of the black toner image, the laser beam only sufficient to deposite an amount of toner which is not more than approx. 1/10 of the toner amount required for providing the maximum image density in the normal image forming operation, is applied for a period equal to the period in which the transfer drum 9 is discharged, with a delay of time corresponding to substantially 1/5 rotation of the photosensitive drum. By this, a latent image is formed. The latent image is attain developed by the black developing device 7BK at the developing position, so that the black toner layer is formed on the photosensitive drum 3. The black developing device 7BK is moved after the development, and the developing device 7BK is fixed to the home position (resting position). After the separation of the recording material P from the transfer drum 9, the photosensitive drum 3 is rotating with the black toner layer thereon, when it is rotated in contact with the photosensitive drum 3 for the electrical discharge. The black toner layer, as will be understood from the above-described timing chart, is such that the toner layer ends on the photosensitive drum at the transfer position simultaneously with the end of the rotation of the transfer drum 9. The photosensitive drum 3 continues the rotation, and the black toner layer thereon is removed by the cleaning device 19. Thereafter, the rotation thereof is stopped.

In the laser beam printer 1 of this structure, the duplex copy operations were carried out a plurality of times. When the recording material carrying sheet 11 is directly contacted to the photosensitive drum 3, the toner layer is formed on the photosensitive drum 3, and therefore, it has been confirmed that the parting agent 43 is prevented from being deposited again on the photosensitive drum after being transferred to the recording material carrying sheet 11 from the recording material P. By doing so, the improper image formation attributable to the parting agent 43 on the photosensitive drum 3 depositing to the subsequent recording material P, can be effectively prevented.

In this embodiment, the rotary type developing device 7 is used, and therefore, when the developing device 7 moves, there exists an area in which the toner layer is not formed on the photosensitive drum 3 for such a region, however, the connecting portion 10*c* of the transfer drum 9 meets the photosensitive drum, by the timing control, and therefore, the re-deposition of the parting agent 43 in the region without the toner, is not a problem.

Figure 16:
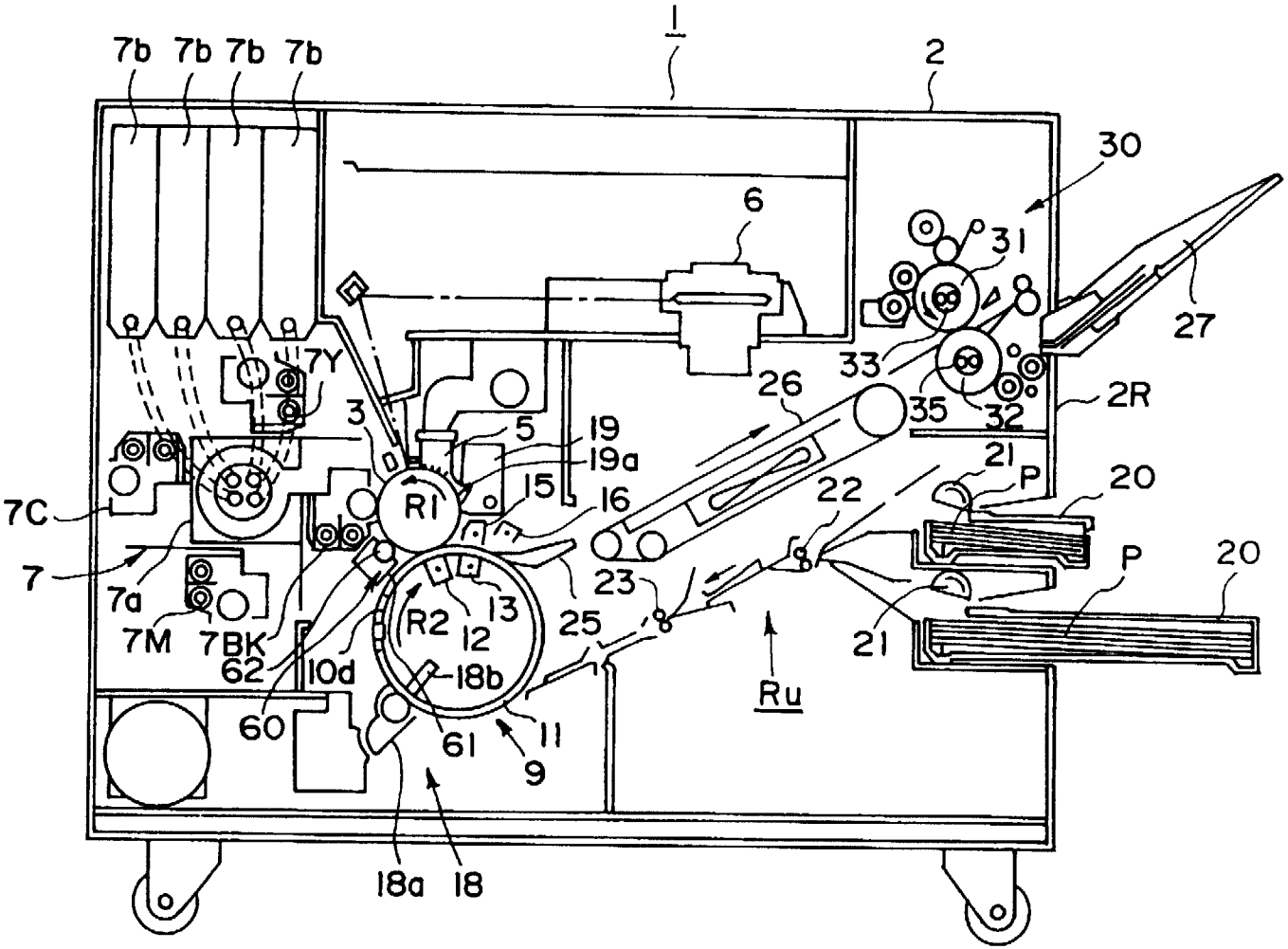
FIG. 16 is a sectional view of an image forming apparatus.

A further embodiment will be described in which the spacer particles are not toner particles. As shown in FIG. 16, in the laser beam printer 1 of FIG. 1, a spacer particle applicator 60 for applying the spacer particles S on the photosensitive drum 3, is disposed adjacent the outer peripheral surface of the photosensitive drum 3 between the developing position and the transfer position.

The spacer particles S is of, for example, fluorocarbon, alumina, titanium oxide, selenium oxide, aluminum hydride, calcium carbide, silica, PVdF, activated carbon or toner particles for image formation. The desirable particle size is 0.05–20 μm approximately. The particles preferably have triboelectrical chargeability. If so, the container may be provided with a stirring member or charging member, so that proper amount of electric charge is given. Then, the particles may be stably deposited electrostatically to the photosensitive drum 3 by the application roller 62.

Figure 17:
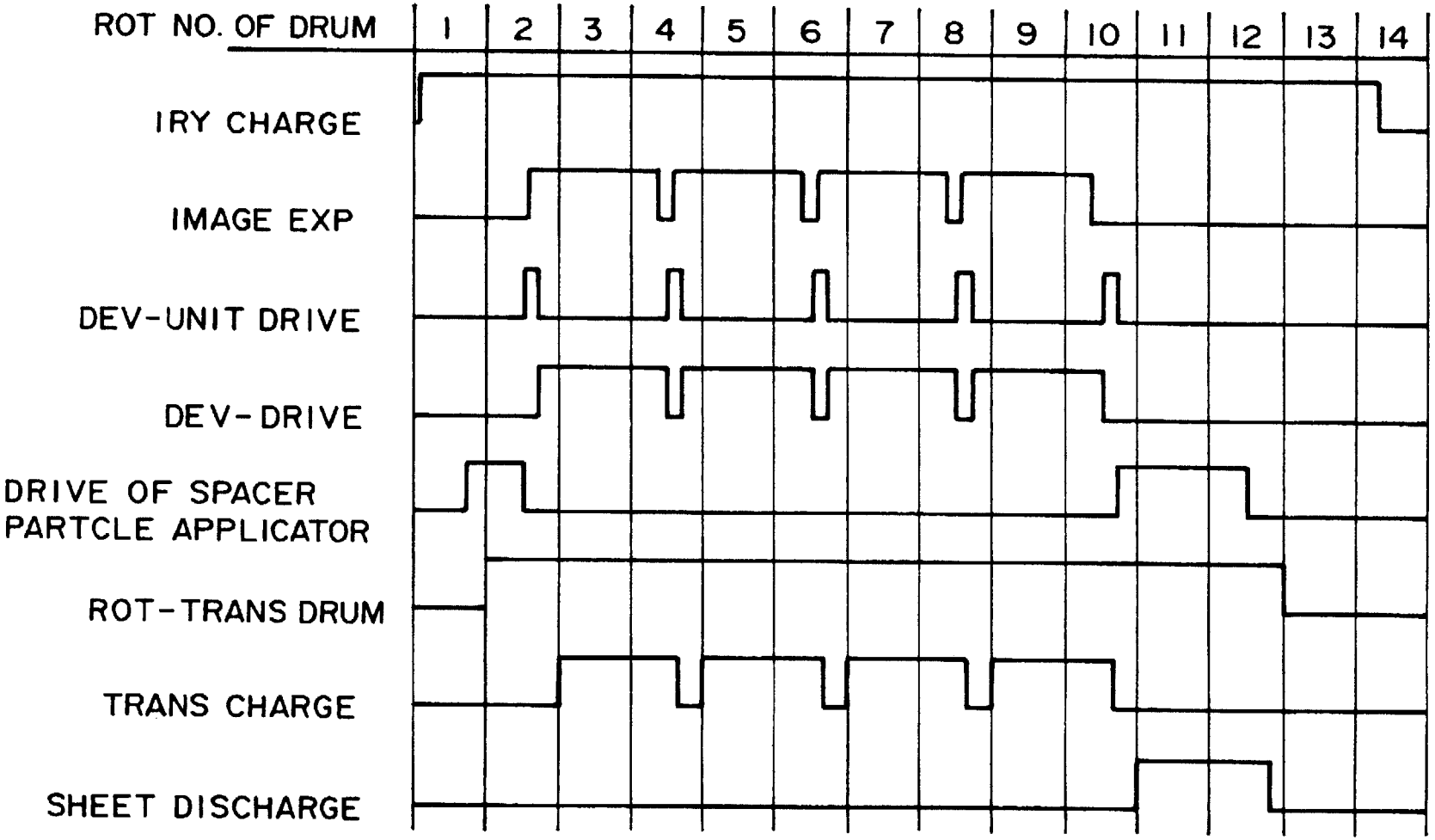
FIG. 17 is a timing chart of various operations of an image forming apparatus.
Figure 18:
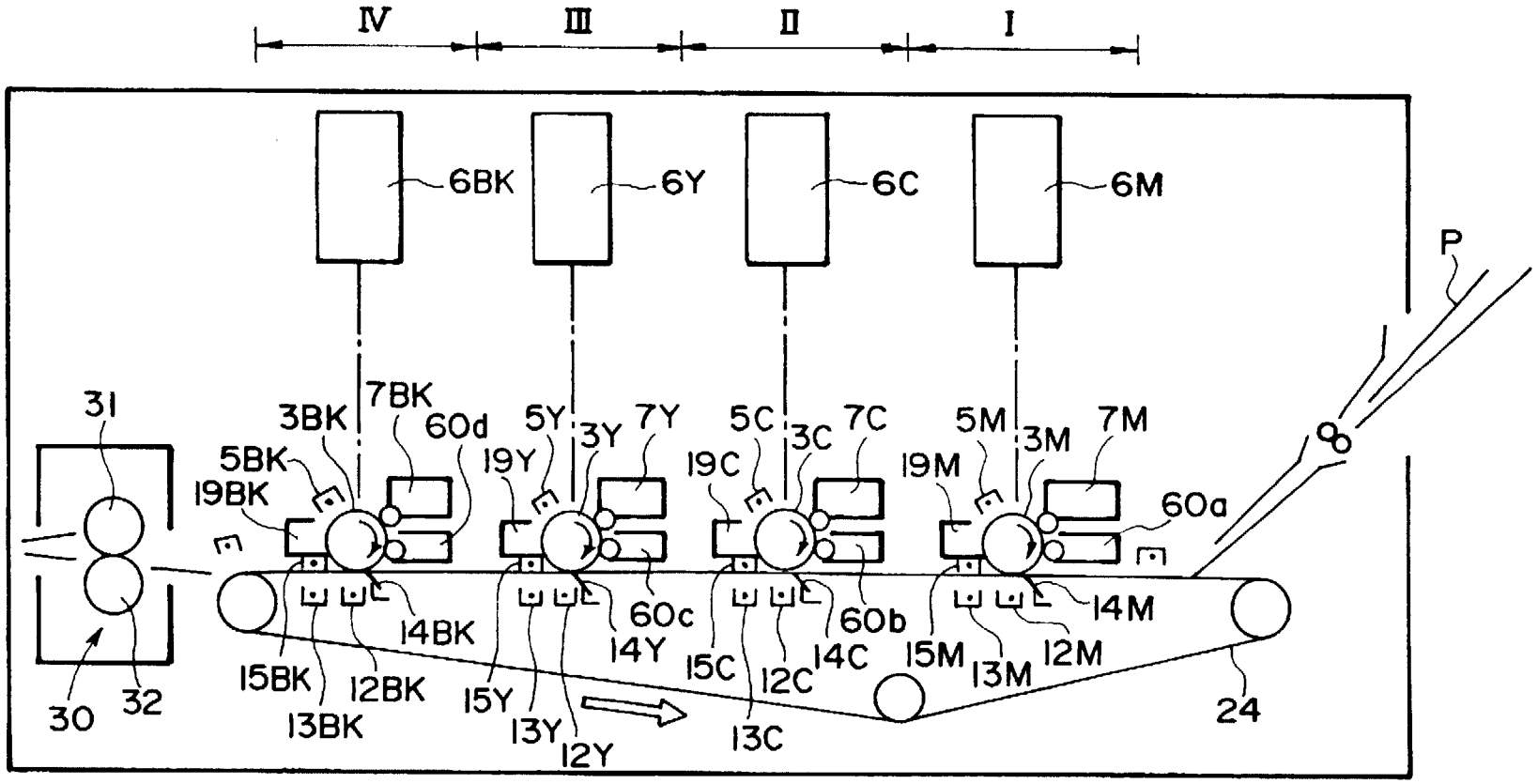
FIG. 18 is a sectional view of an image forming apparatus.

FIG. 17 is a timing chart illustrating operations of primary charging, image exposure, developing unit movement, developing device actuation, spacer particle applicator drive, transfer drum rotation, transfer charging, the transfer material carrying sheet discharging, which are on the basis of the rotation of the photosensitive drum 3. As will be understood from the timing chart, as compared with the foregoing embodiment, the toner layer is not formed on the photosensitive drum before or after the actual image formation, but a spacer particle layer is formed.

With the laser beam printer 1 of this structure, a plurality of duplex copy operations were carried out. When the photosensitive drum 3 and the recording material carrying sheet 11 are directly contacted, the layer of the spacer particles is formed on the photosensitive drum 3, and therefore, it has been confirmed that the improper image formation attributable to the redeposition of the parting agent 43 to the photosensitive drum 3, is prevented.

In the case of four image formation units I, II, III and IV as shown in FIG. 10, the toner layer functioning as the spacer particle layer can be always formed on each of the photosensitive drums during the period in which the transfer belt 24 is directly contacted to the photosensitive drum 3M, 3C, 3Y or 3BK.

In this embodiment, the image forming apparatus used in FIG. 10 embodiment is used. Spacer particle applicators 60*a*, 60*b*, 60*c* and 60*d*, are provided adjacent the outer surface of the photosensitive drums 3M, 3C, 3Y and 3BK between the developing positions and associated transfer positions.

In this embodiment, when the photosensitive drum 3M, 3C, 3Y or 3BK is directly contacted to the conveyer belt 24 before and after the actual image formation, similarly to the embodiment of FIG. 17, he spacer particle layer is formed on the photosensitive drum 3M, 3C, 3Y or 3BK, and therefore, the improper image formation can be avoided, thus permitting good image formation.

As for the timing of providing the spacer particle layer on the image bearing member, it may be such that at least after the completion of the image transfer operation onto the second surface, during the contact between the image bearing member and the recording material carrying member, the spacer particles exist therebetween.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

image bearing means;

a movable recording material carrying member for carrying a recording material, wherein an image is transferred at a transfer position from said image bearing means onto a recording material carried on a carrying surface of said recording material carrying member;

a plurality of linear recesses provided on the carrying surface and extending in a direction of movement of said recording material carrying member; and cleaning means for cleaning the carrying surface of said recording material carrying member, said cleaning means including a rotatable brush movable in a rotational direction, wherein the linear recesses extend in the direction of rotational movement of said rotatable brush.

2. An apparatus according to claim 1, wherein the recesses have ten point average roughness of 7–20 μm, an average peak intervals of not more than 30 μm, and a maximum roughness of not more than 30 μm, in a direction substantially perpendicular to the movement direction.

3. An apparatus according to claim 1, wherein the recesses have ten point average roughness of 10–15 μm, an average peak intervals of not more than 20 μm, and a maximum roughness of not more than 20 μm, in a direction substantially perpendicular to the movement direction.

4. An apparatus according to claim 1, wherein said cleaning means includes a brush having a fiber thickness smaller than an average peak interval of the linear recesses in a direction perpendicular to the movement direction.

5. An apparatus according to claim 1, further comprising fixing means for fixing the image on the recording material, said fixing means comprising a fixing rotatable member contactable to the image on the recording material, and applicator means for applying a parting agent to the fixing rotatable member.

6. An apparatus according to claim 5, wherein after the image is fixed on, a first side of the recording material by said fixing means an image can be transferred onto a second side of the recording material.

7. An apparatus according to claim 6, further comprising forming means for forming a layer of particles between said recording material carrying member and an image fixed on the first side of the recording material.

8. An apparatus according to claim 7, wherein an image can be formed on a second side after a first image is fixed on the recording material by said fixing means.

9. An apparatus according to claim 7 or 8, wherein said forming means forms the particle layer on the first side of the recording material before the recording material is carried on said recording material carrying member to effect image transfer on a second side of the recording material.

10. An apparatus according to claim 7 or 8, wherein said forming means forms the particle layer on a surface of said recording material carrying member for carrying the recording material before the carrying material is carried on said recording material carrying member to effect image transfer onto the second side of the recording material.

11. An apparatus according to claim 10, wherein said forming means develops the image bearing means with toner, and the particle layer is formed with toner.

12. An apparatus according to claim 6, further comprising forming means for forming a layer of particles between said image bearing means and said recording material carrying member when there is no recording material in the transfer position.

13. An apparatus according to claim 12, wherein said forming means forms a layer of particles on said image bearing means.

14. An apparatus according to claim 13, wherein said forming means develops said image bearing means with toner, and the particle layer is formed with the toner.

15. An apparatus according to claim 12, wherein the particle layer is interposed between said image bearing means and said recording material carrying member after completion of image transfer onto the second side of the recording material.

16. An apparatus according to claim 1, wherein different color images can be superposedly transferred from the image bearing means onto the recording material carried on said recording material carrying member.

17. An apparatus according to claim 16, wherein said image bearing means comprises a plurality of image bearing members, and the different color images can be transferred from the image bearing members onto the recording material carried on said recording material carrying member.

18. An apparatus according to claim 16, wherein said apparatus is capable of forming a full-color image on the recording material.

19. An image forming apparatus comprising:

image bearing means;

a movable recording material carrying member for carrying a recording material, wherein an image is transferred at a transfer position from said image bearing means onto a recording material carried on said recording material carrying member;

fixing means for fixing the image on the recording material, wherein said fixing means includes a fixing rotatable member contactable to the image on the recording material and applicator means for applying a parting agent to said fixing rotatable member;

wherein after the image is fixed on a first side of the recording material by said fixing means, an image can be transferred onto a second side of the recording material;

forming means for forming a layer of particles between said recording material carrying member and an image fixed on the first side of the recording material; and means for cleaning such a surface of said recording material carrying member as is capable of carrying the recording material.

20. An apparatus according to claim 19, wherein said forming means forms the particle layer on the first side of the recording material before the recording material is carried on said recording material carrying member to effect image transfer on the second side of the recording material.

21. An apparatus according to claim 19, wherein said forming means forms the particle layer on a surface of said recording material carrying member for carrying the recording material before the recording material is carried on said recording material carrying member to effect image transfer onto the second side of the recording material.

22. An apparatus according to claim 21, wherein said forming means develops the image bearing means with toner, and the particle layer is formed with toner.

23. An apparatus according to claim 19, wherein said image forming means forms a layer of particles between said image bearing means and said recording material carrying member when there is no recording material in the transfer position.

24. An apparatus according to claim 23, wherein said forming means forms a layer of particles on said image bearing means.

25. An apparatus according to claim 24, wherein said forming means develops said image bearing means with toner, and the particle layer is formed with the toner.

26. An apparatus according to claim 23, wherein the particle layer is interposed between said image bearing means and said recording material carrying member after completion of image transfer onto the second side of the recording material.

27. An apparatus according to claim 19, wherein different color images can be superposedly transferred from the image bearing means onto the recording material carried on said recording material carrying member.

28. An apparatus according to claim 27, wherein said image bearing means comprises a plurality of image bearing members, and the different color images can be transferred from the image bearing members onto the recording material carried on said recording material carrying member.

29. An apparatus according to claim 27, wherein said apparatus is capable of forming a full-color image on the recording material.

30. An image forming apparatus comprising:

image bearing means;

a movable recording material carrying member for carrying a recording material, wherein an image is transferred at a transfer position from said image bearing means onto a recording material carried on said recording material carrying member;

fixing means for fixing the image on the recording material, wherein said fixing means includes a fixing rotatable member contactable to the image on the recording material and applicator means for applying a parting agent to said fixing rotatable member;

wherein after the image is fixed on a first side of the recording material by said fixing means, an image can be transferred onto a second side of the recording material; and layer forming means for forming a layer of particles between said image bearing means and said recording material carrying member when the transfer position does not have the recording material.

31. An apparatus according to claim 30, wherein said layer forming means forms a layer of particles on said image bearing means.

32. An apparatus according to claim 31, wherein said layer forming means develops said image bearing means with toner, and the particle layer is formed with the toner.

33. An apparatus according to claim 30, wherein the particle layer is interposed between said image bearing means and said recording material carrying member after completion of image transfer onto the second side of the recording material.

34. An apparatus according to claim 30, wherein different color images can be superposedly transferred from the image bearing means onto the recording material carried on said recording material carrying member.

35. An apparatus according to claim 34, wherein said image bearing means comprises a plurality of image bearing members, and the different color images can be transferred from the image bearing members onto the recording material carried on said recording material carrying member.

36. An apparatus according to claim 34, wherein said apparatus is capable of forming a full-color image on the recording material.

37. An apparatus according to claim 30, further comprising collecting means for collecting the particles in the layer.

38. An image forming apparatus comprising:

image bearing means;

a movable recording material carrying member for carrying a recording material, a surface of said recording material carrying member being provided with a plurality of linear recesses having closed bottom portions extending substantially in a direction of movement of said carrying member, wherein an image on said image bearing means is transferred onto the recording material carried on said carrying member at an image transfer station; and cleaning means, contactable to the surface, for cleaning the surface of said recording material carrying member.

39. An apparatus according to claim 38, wherein the surface has a ten point average roughness of 7–20 microns, and average peak intervals of not more than 30 microns, in a direction substantially perpendicular to the movement direction.

40. An apparatus according to claim 38, wherein the surface has a ten point average roughness of 10–15 microns, and average peak intervals of not more than 20 microns, in a direction substantially perpendicular to the movement direction.

41. An apparatus according to claim 38, wherein said cleaning means includes a brush, and the brush has a size which is smaller than an interval between bottom portions of said recording material carrying member in a direction perpendicular to a movement direction of said recording material carrying member.

42. An apparatus according to claim 38, further comprising fixing means for fixing the image on the recording material, said fixing means comprising a fixing rotatable member contactable to the image on the recording material, and applicator means for applying a parting agent to the fixing rotatable member.

43. An apparatus according to claim 42, further comprising means for transferring an image onto a second side of the recording material.

44. An apparatus according to claim 43, further comprising forming means for forming a layer of particles between said recording material carrying member and an image fixed on the first side of the recording material.

45. An apparatus according to claim 44, wherein the image is formed on the second side after a first image is fixed on the recording material by said fixing means.

46. An apparatus according to claim 44 or 45, wherein said forming means forms the particle layer on the first side of the recording material before the recording material is carried on said recording material carrying member to effect image transfer on a second side of the recording material.

47. An apparatus according to claim 44 or 45, wherein said forming means forms the particle layer on a surface of said recording material carrying member for carrying the recording material before the carrying material is carried on said recording material carrying member to effect image transfer onto the second side of the recording material.

48. An apparatus according to claim 47, wherein said forming means develops the image bearing means with toner, and the particle layer is formed with toner.

49. An apparatus according to claim 43, further comprising forming means for forming a layer of particles between said image bearing means and said recording material carrying member when there is no recording material in the transfer position.

50. An apparatus according to claim 49, wherein said forming means forms a layer of particles on said image bearing means.

51. An apparatus according to claim 50, wherein said forming means develops said image bearing means with toner, and the particle layer is formed with the toner.

52. An apparatus according to claim 49, wherein the particle layer is interposed between said image bearing means and said recording material carrying member after completion of image transfer onto the second side of the recording material.

53. An apparatus according to claim 38, further comprising means for superposedly transferring different color images from the image bearing means onto the recording material carried on said recording material carrying member.

54. An apparatus according to claim 53, wherein said image bearing means comprises a plurality of image bearing members, and the different color images can be transferred from the image bearing members onto the recording material carried on said recording material carrying member.

55. An apparatus according to claim 53, wherein said apparatus is capable of forming a full-color image on the recording material.

56. An apparatus according to claim 38, wherein said recording material carrying member has a sheet.

* * * * *

UNITED STATES PATENT AND TRADEMARK OFFICE

CERTIFICATE OF CORRECTION

PATENT NO. : 5,784,675

DATED : July 21, 1998

INVENTORS : MASAHIRO INOUE, ET AL.

It is certified that error appears in the above-identified patent and that said Letters Patent is hereby corrected as shown below:

On the title page

COLUMN [56] RC,

Line FPD, "4-249278 4/1992 Japan" should read --4-249278 9/1992 Japan--.

COLUMN [57] ABSTRACT,

Line 1, "image an" should read --an image--.

COLUMN 1,

Line 34, "loosing" should read --losing--.

COLUMN 3,

Line 56, "a" should read --and a--.

COLUMN 5,

Line 16, "are" should read --is--; and
Line 46, "dery" should read --der--.

UNITED STATES PATENT AND TRADEMARK OFFICE

CERTIFICATE OF CORRECTION

PATENT NO. : 5,784,675

DATED : July 21, 1998

INVENTORS : MASAHIRO INOUE, ET AL.

It is certified that error appears in the above-identified patent and that said Letters Patent is hereby corrected as shown below:

COLUMN 7,

Line 44, "a" should be deleted; and
Line 56, "such" should read --using such--.

COLUMN 8,

Line 8, "thermister 36" should read --thermistor 36--.

COLUMN 9,

Line 28, "of" should read --a--; and
Line 47, "all" should read --all of the--.

COLUMN 10,

Line 10, "is" should read --and is--; and
Line 65, "The rough-" should read --When rough- --.

UNITED STATES PATENT AND TRADEMARK OFFICE

CERTIFICATE OF CORRECTION

PATENT NO. : 5,784,675

DATED : July 21, 1998

INVENTORS : MASAHIRO INOUE, ET AL.

It is certified that error appears in the above-identified patent and that said Letters Patent is hereby corrected as shown below:

COLUMN 11,

Line 67, "a" should read --and a--.

COLUMN 12,

Line 50, "an" should read --a--.

COLUMN 13,

Line 63, "article" should read --particle--.

COLUMN 14,

Line 4, "charging, will be described." should read --charging.--; and
Line 13, "deposite" should read --deposit--.

UNITED STATES PATENT AND TRADEMARK OFFICE

CERTIFICATE OF CORRECTION

PATENT NO. : 5,784,675

DATED : July 21, 1998

INVENTORS : MASAHIRO INOUE, ET AL.

It is certified that error appears in the above-identified patent and that said Letters Patent is hereby corrected as shown below:

COLUMN 16,

Line 52, "is" should read --are composed--.

COLUMN 17,

Line 14, "be always" should read --always be--;
Line 27, "he" should read --the--;
Line 61, "an" should be deleted; and
Line 66, "an" should be deleted.

COLUMN 18,

Line 13, "on," should read --on--; and
Line 16, "means" should read --means,--.

UNITED STATES PATENT AND TRADEMARK OFFICE

CERTIFICATE OF CORRECTION

PATENT NO. : 5,784,675

DATED : July 21, 1998

INVENTORS : MASAHIRO INOUE, ET AL.

It is certified that error appears in the above-identified patent and that said Letters Patent is hereby corrected as shown below:

Sheet 13

Figure 14:
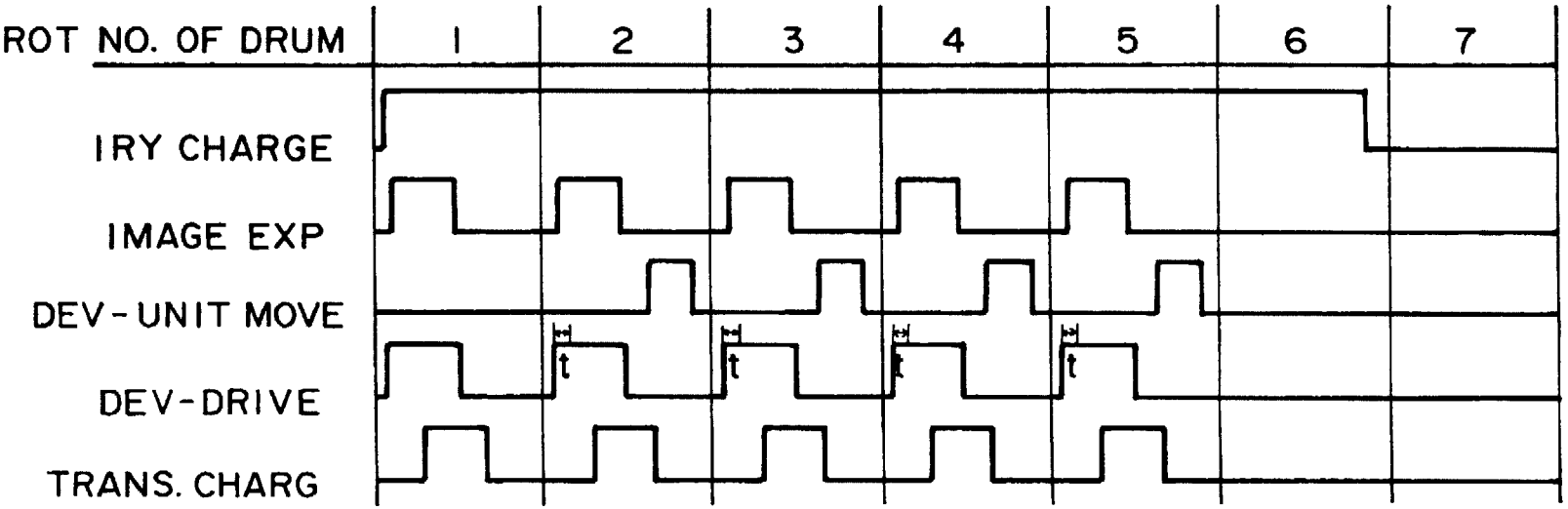
FIG. 14 is a timing chart of operations of various parts of an image forming apparatus.

Figure 14, "TRANS. CHARG" should read --TRANS. CHARGE--.

Sheet 16

Figure 17, "PARTCLE" should read --PARTICLE--.

Signed and Sealed this

Thirty-first Day of August, 1999

*Attest:*

Q. TODD DICKINSON

*Attesting Officer*

*Acting Commissioner of Patents and Trademarks*